US005125566A

United States Patent [19]

Deiger

[11] Patent Number: 5,125,566

[45] Date of Patent: Jun. 30, 1992

[54] DISPENSING CONTAINER WITH MODIFIED CORNER STRUCTURE

[76] Inventor: Anthony J. Deiger, 2761 Riva Ridge Rd., Toledo, Ohio 43615

[21] Appl. No.: 670,980

[22] Filed: Mar. 18, 1991

Related U.S. Application Data

[63] Continuation-in-part of Ser. No. 447,788, Dec. 8, 1989, Pat. No. 5,000,374, which is a continuation-in-part of Ser. No. 310,108, Feb. 10, 1989, Pat. No. 4,919,326.

[51] Int. Cl.[5] ..... B65D 43/20

[52] U.S. Cl. ..... 229/125.15; 229/110; 220/461

[58] Field of Search ..... 206/621.2, 621.3, 626; 229/125.42, 109, 215, 219, 110; 220/461, 403

[56] References Cited

U.S. PATENT DOCUMENTS

| | | | |
|---|---|---|---|
| 3,160,341 | 12/1964 | Cherney | 229/125.42 |
| 3,306,514 | 2/1967 | MacKendrick | 229/219 |
| 3,512,697 | 3/1970 | Robinson | 229/109 |
| 3,982,683 | 9/1976 | Forteau | 206/621.3 |
| 4,209,092 | 6/1980 | Jones | 229/139 |
| 4,572,422 | 2/1986 | Heuberger et al. | 220/462 |
| 4,657,174 | 4/1987 | Hennig | 206/626 |
| 4,673,125 | 6/1987 | Weaver | 220/403 |
| 4,765,534 | 8/1988 | Zion et al. | 229/109 |
| 4,830,273 | 5/1989 | Kalberer et al. | 229/125.42 |
| 4,919,326 | 4/1990 | Deiger | 229/109 |
| 4,971,243 | 11/1990 | Lisiecki | 229/125.15 |
| 5,000,374 | 3/1991 | Deiger | 229/109 |
| 5,042,682 | 8/1991 | Ritter et al. | 220/403 |

*Primary Examiner*—Stephen Marcus
*Assistant Examiner*—Christopher McDonald
*Attorney, Agent, or Firm*—David C. Purdue; John C. Purdue

[57] ABSTRACT

A dispensing container is disclosed. The container can be formed from a unitary prescored blank. The container comprises first and second main panels, four major side walls and at least one minor side wall which extends between to adjacent major side walls and cuts the corner that would otherwise be formed by the two major side walls. The minor side wall is constituted by a first, inner minor side wall panel connected to the first main panel and disconnected from the second main panel and a first, outer minor side wall panel connected to the second main panel and disconnected from the first main panel. A content dispensing device is associated with the minor wall so that it does not extend beyond the corner which would otherwise be formed by the two adjacent major side walls. The container can be shipped with the dispensing element in place. In applications involving liquid products, a liquid impervious liner is provided on the inside of the container. An integral prescored blank for producing the dispensing container is also disclosed.

10 Claims, 18 Drawing Sheets

FIG. 25
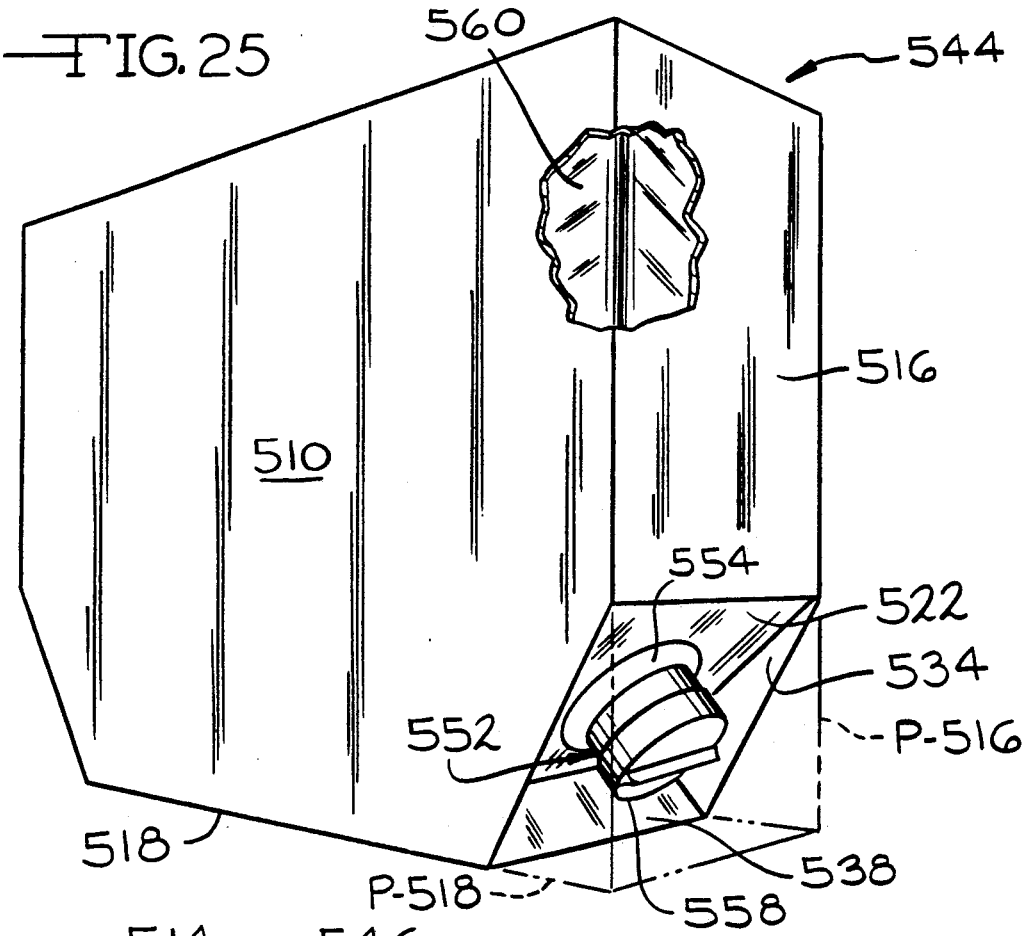
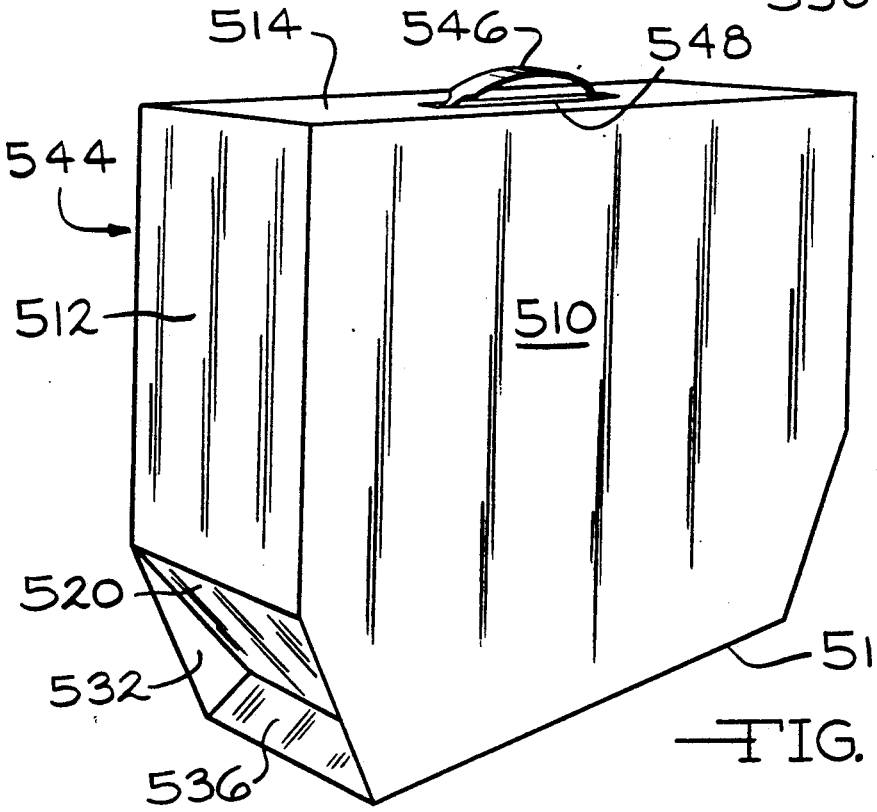
FIG. 26

DISPENSING CONTAINER WITH MODIFIED CORNER STRUCTURE

REFERENCE TO RELATED APPLICATION

This is a continuation-in-part of application Ser. No. 447,788 filed Dec. 8, 1989, now U.S. Pat. No. 5,000,374 issued Mar. 19, 1991, which application was, in turn, a continuation-in-part of application Ser. No. 310,108 filed Feb. 10, 1989, now U.S. Pat. No. 4,919,326 issued Apr. 24, 1990.

BACKGROUND OF THE INVENTION

This invention relates to containers which are especially suited for storing, shipping and dispensing a wide variety of products, including liquid products, granular products and products that are normally stored on a roll such as plastic films and aluminum foil as well as products that can be stored on a reel, such as wire and rope. More specifically, the invention is concerned with such containers featuring at least one modified corner structure including a product dispensing element. The type of dispensing element utilized in a particular application will be determined primarily by the type of product which is to be stored in and dispensed from the container. For example, a container for liquid products would suitably be provided with a valve in the modified corner structure. A container for coiled wire, on the other hand, would be provided with an opening in the modified corner structure, through which the wire could be pulled.

There are a number of prior art dispensing containers designed for various products. In the field of liquid dispensing containers, there are a number of variations on a basic design which can be called a bag in a box. Typically, a plastic bag with an integral spout is packaged within a rectangular carton. An opening is provided in the carton and the end user of the carton retrieves the spout and pulls it through the opening, out of the carton and secures the spout to the sides of the opening. Such dispensing containers have been used for comestible products like wine and also for cleaning products such as liquid detergents. In order to provide the requisite strength to contain large quantities of liquid, the cartons used in such containers are made from double wall corrugated board.

Granular products are shipped and stored in, and dispensed from, a wide variety of containers Coiled or rolled products, such as foils and plastic wrapping materials are typically dispensed from rolls after they have been removed from shipping containers.

U.S. Pat. No. 3,512,697 discloses an octagonal container in which diagonal corner elements reinforce the top and bottom. U.S. Pat. No. 4,765,534 discloses several embodiments of an octagonal pizza container with diagonal corner forming elements. Each one of the elements is connected to the bottom of the container and one of two adjacent side walls, but is disconnected from the other adjacent side wall.

There remains a need for improved containers which are suitable for shipping, storing and dispensing products conveniently and expeditiously In addition, it would be desirable to produce a container of single wall corrugated board or other materials which are less expensive than double wall corrugated board, wherein the design of the container is such that it possesses the required strength. There is also a need for a liquid dispensing container including a dispensing element which can be secured to the container when it is filled and remain in place while the container is shipped in a larger carton with other such containers.

Accordingly, it is an object of the invention to provide a container for shipping, storing and dispensing a product. It is a further object of the invention to provide such a container, including a dispensing element which is supported on the container in such a way that it does not interfere with shipping the loaded container in a large carton with other such containers. It is yet another object of this invention to provide a container which has outstanding strength and is easy to assemble in automated packaging equipment. These and other objects are achieved in accordance with the invention described hereinbelow and illustrated in the attached drawings, particularly in FIGS. 24 through 32.

SUMMARY OF THE INVENTION

The invention is a dispensing container for liquid and powdered or granulated products, as well as products which are coiled or rolled. In a preferred embodiment, the container includes four major side walls and at least one minor wall which cuts the corner that would otherwise be formed by two adjacent major side walls. A content dispensing device is provided on the minor wall. The dispensing device is supported on the minor, corner cutting wall so that the device does not extend beyond the corner which would otherwise be formed by the two adjacent major side walls. Consequently, a plurality of such containers, with their dispensing devices in place, can be shipped in a conventional carton and arrive at their destination ready for use. In applications involving liquid products, a liquid impervious liner is provided on the inside of the carton. In a preferred embodiment, especially suited for liquids and other heavy contents, there are three major, inner side walls attached to a first panel, three major outer walls attached to a second, opposed panel, and a fourth side wall connecting the first and second opposed panels. Preferably, the inner and outer side walls are glued, one to the other. It is preferred to provide inner and outer minor side walls, as well.

The instant invention is also concerned with an integral prescored blank for producing a dispensing container. In one embodiment, the blank is scored and cut to define a first panel with three major, inner side walls depending from it, a second panel with three major, outer side walls depending from it and a fourth side wall connected to both the first and second panels. First and second outer, minor walls are connected to two of the outer major side walls and to coupling panels which, in turn, are connected to the second panel and first and second inner, minor side walls are connected to two of the major, inner side walls and to coupling panels which, in turn, are connected to the first panel. At each end of the fourth side wall, there is a set up panel and the coupling panels are connected to the set up panels as well as to the first and second panels and the minor walls. The set up panels are designed so that they can be manipulated to cause the blank to conform to the final shape of the container, as explained in more detail hereinafter.

BRIEF DESCRIPTION OF THE DRAWINGS

FIG. 25 is a perspective view of a liquid dispensing container including a dispensing valve mounted on a lower, minor, corner cutting side wall.

FIG. 26 is a perspective view showing a carrying handle provided on top of the liquid dispensing container shown in FIG. 25.

In FIGS. 2, 4, 12, 17, 18, 20, 22 and 24, dotted lines represent scored or perf-scored regions between connected elements while solid lines represent die cut regions between disconnected elements. The FIGURES which illustrate blanks are drawn to scale.

DETAILED DESCRIPTION OF THE INVENTION

Figure 1:
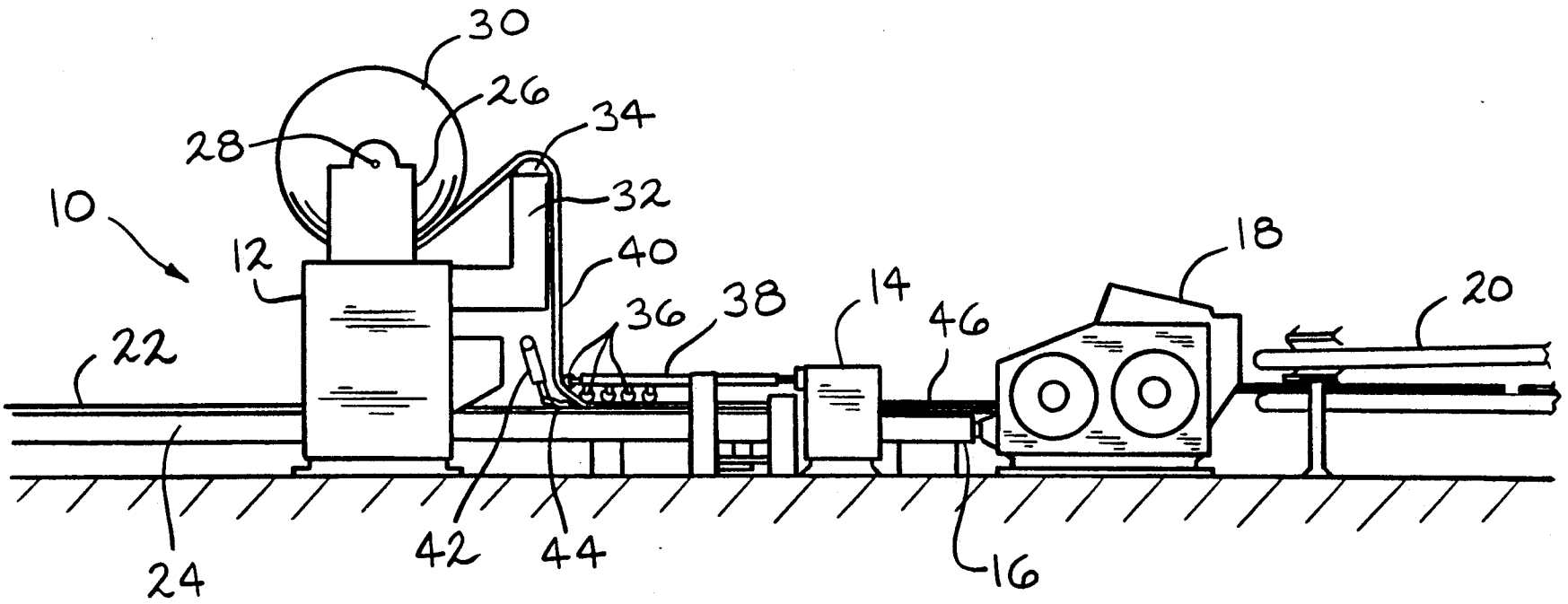
FIG. 1 is a side view of a corrugator to produce composite material comprising strips of insulative material adhered to portions of corrugated board.

A portion of a modified double face corrugating machine is indicated generally at 10 in FIG. 1 The corrugating machine 10 includes a pulley belt station 12, an automated slitter station 14, a transfer table 16, a cut-off knife 18 and a stacker 20. Corrugated material 22 moves through the corrugating machine 10 from left to right in FIG. 1 along a conveyor 24. The components of the corrugating machine 10 thus far described are conventional and can be modified in a manner described hereinbelow so that it can produce a composite corrugated material which can be die cut into a composite blank from which a container according to the present invention can be readily assembled.

A pair of bulk roll supports 26 are mounted on top of the pulley belt station 12. A shaft 28 is supported on the bulk roll supports 26 and extends across the conveyor 22. Rotatably supported on the shaft 28 are a plurality of rolls 30 of insulative cushioning material such as a foamed polystyrene or other elastomeric material. A guide bar 32 is secured to the pulley belt station 12. A roller 34 is rotatably supported on the guide bar 32. The roller 34 may include conventional means for guiding and positioning the strips of cushioning material supplied from the rolls 30 as well as means for tensioning the cushioning material as it passes over the roller 34. A plurality of pressure rollers 36 are rotatably mounted relative to a support bar 38. The pressure rollers 36 serve to apply pressure to cushioning material 40 as it passes between the pressure rollers 36 and the corrugated material 22. Together, the bulk roll supports 26, the shaft 28 and the guide bar 32 with its associated roller 34 constitute means for supplying strips of a cushioning material from a plurality of rolls 30 to be bonded to corrugated material 22 as it moves through the corrugating machine 10. These elements could be provided at a variety of positions along the corrugating machine 10. For economy of manufacture, it is desirable to bond cushioning material supplied from the rolls 30 to corrugated material 22 before it is cut and stacked.

A plurality of nozzles 42 are provided for applying a bonding agent, indicated at 44, delivered thereto by conventional equipment (not shown) to the upper surface of the corrugated material 22. The bonding agent 44 should have good adhesion properties relative to the cushioning material 40 supplied from the rolls 30 as well as to the corrugated material 22. Accordingly, as the modified corrugating machine 10 is operated and corrugated material 22 advances from left to right, bonding agent 44 is applied to selected areas on the corrugated material 22. Cushioning material from the rolls 30 is then applied to selected areas of the corrugated material 22 where the bonding agent 44 has been applied. Finally, pressure rollers 36 serve to apply downward pressure to facilitate bonding of the strips of insulative, cushioning material 40 from the rolls 30 to the corrugated material 22 to produce a composite stock material 46. The stock material comprising corrugated material with parallel, spaced apart strips of insulative, cushioning material bonded thereto, advances to the automated slitter station 14 or the automated cutter station 18 for cutting to produce a composite blank of a desired size. The rolls 30 of cushioning material can have various widths, depending on the type and style of a container to be produced from a given stock material 54. Cushioning material composed of polymeric foam are produced commercially in very wide rolls. A plurality of rolls 30 of a desired width can be cut from a roll of commercial width cushioning material and used sequentially in apparatus of the type illustrated in FIG. 1. Several embodiments of composite containers which can be produced from the composite material 46 in accordance with this invention are described below.

Figure 2:
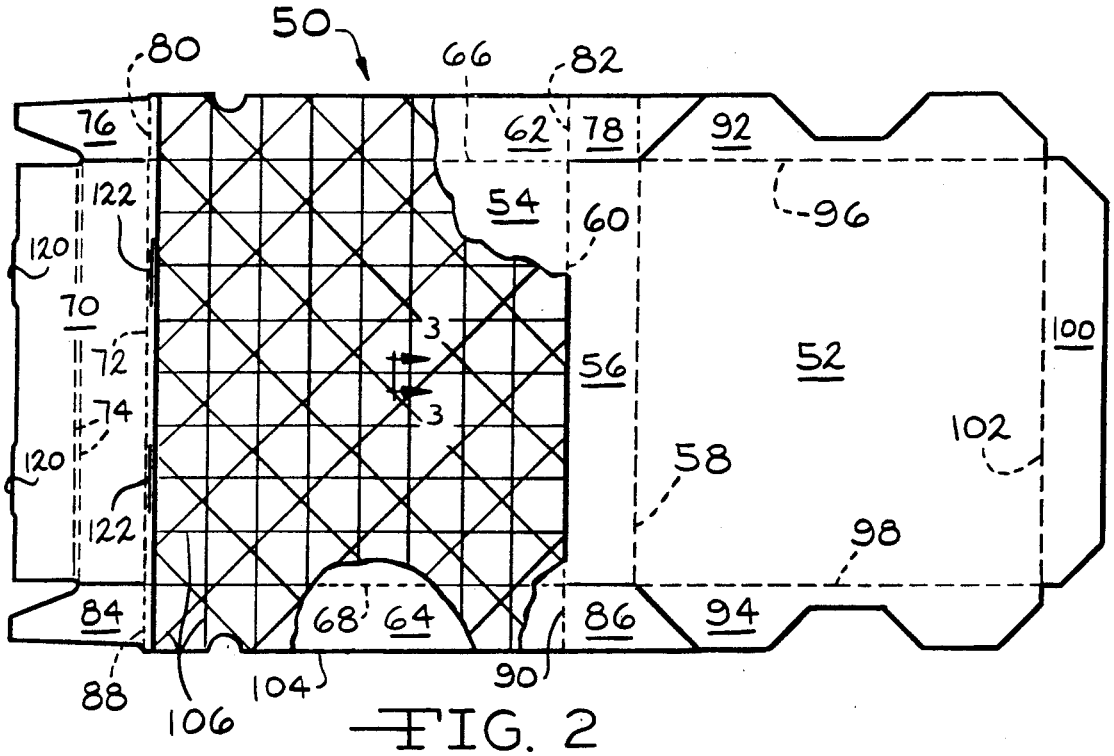
FIG. 2 is a plan view of a blank from which a container according to the present invention can be produced.

Referring to FIG. 2, there is illustrated a composite blank, indicated generally at 50, from which a container according to one embodiment of the invention can be produced. The blank 50 comprises a top panel 52, a bottom panel 54 and a rear wall 56 hingedly connecting the two panels 52 and 54 by means of fold lines 58 and 60. Opposed side walls 62 and 64 are connected to and extend outwardly from two edges of the bottom panel 54, defined by fold lines 66 and 68, respectively. A front panel 70 extends from and is connected to the front edge of the bottom panel 54, defined by a fold line 72. Double fold lines 74 are provided on the front panel 70 so that it can be folded to produce a double thick front wall. Reinforcing tabs 76 and 78 extend from opposite ends, defined by fold lines 80 and 82, of the side wall 62. Similarly, reinforcing tabs 84 and 86 extend from opposite ends, defined by fold lines 88 and 90, of the side wall 64. Side flaps 92 and 94 extend from side edges, defined by fold lines 96 and 98, respectively, of the top panel 52. A front flap 100 extends from the front edge, defined by fold line 102, of the top panel 52. This much of the blank 50 is composed, preferably, of double face corrugated material.

A layer of relatively thin insulative material 104 is adhered in face-to-face relationship with corrugated material constituting the bottom panel 54 and the side walls 62 and 64. The material 104, although broken away for illustrative purposes, extends from the free edge of the side wall 62 to the free edge of the side wall 64, and extends from the first one of the fold line 72 to the fold line 60. Thus, the blank 50 can be cut from a continuous sheet of composite material which can be produced on the modified double corrugating machine 10 (FIG. 1). The composite material would consist of a strip of the material 104, which could be supplied from the roll 30, adhered in face-to-face relationship with corrugated board. The insulative material 104 can be an extruded polystyrene which will act as a thermal insulator to keep a pizza hot and, because its integrity is unaffected by heat and moisture, it will insulate or protect the flavor of the pizza unlike the cardboard and corrugated board materials currently in use in pizza containers. Extruded polystyrene will not absorb oil or grease from a hot pizza.

As clearly shown in FIG. 2, the material 104 is adhered only to the bottom panel 54 and the two side walls 62 and 64. The other elements of the blank 50 are constituted only of corrugated board. It has been determined that, if a thermally insulative and water impervious material such as extruded polystyrene is adhered to most or all of the interior surfaces of a pizza container, when a pizza is closed up inside such a container, excessive condensation will occur inside the container to the extent that the pizza will become soggy and unpalatable. Accordingly, in a pizza container according to the present invention, insulative material is adhered to substantially all of the bottom panel and such material is not adhered to substantially all of the top panel. The side walls and the front wall and rear wall may or may not have insulative material adhered to them although, as noted above, there is a substantial manufacturing advantage attendant to bonding strips of insulative material to a portion of corrugated board, before it is cut into blanks. This eliminates the steps involved in cutting the insulative material by combining that step with the step of cutting the corrugated board. It should be appreciated that the function of the top panel 52 and the bottom panel 54 can be reversed by adhering the insulative material 104 to the top panel 52 and not to the bottom panel 54, if desired. The illustrated construction is preferred, however.

As shown in FIG. 2, the exposed surface of the insulative material 104 is patterned. Specifically, channels 106 are formed in the surface of the insulative material 104. The channels 106 constitute means for releasing steam and moist air from between the insulative material 104 and the crust of a pizza pie. Without such means, the underside of the pizza crust would become soggy and unappetizing. The particular type of channel pattern is not critical so long as it allows for the escape of moist air from between the insulative material and the underside of the pizza crust. The channels can be formed by an embossing die which could be combined with a cutting die. Alternatively, the channels could be formed in a separate step.

Figure 3:
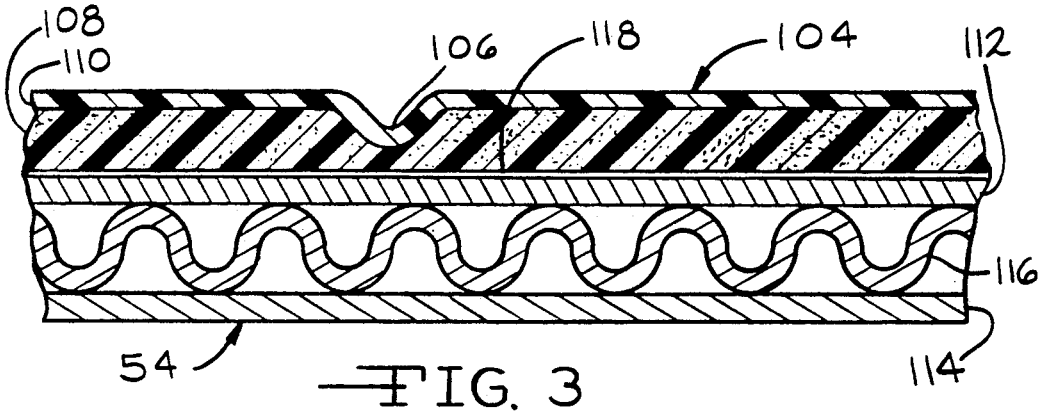
FIG. 3 is a sectional view taken along the line 3—3 of FIG. 2.

FIG. 3 illustrates a preferred type of insulative material 104 comprising a very thin sheet of extruded polystyrene 106 with an integral skin 108 consisting of high impact polystyrene laminated to the surface of the extruded polystyrene 106. The material 104 is commercially available and is preferred for use in pizza containers for "high volume" pizza shops where seconds count. The skin 108 is so durable that a whole pizza pie can be placed on the material 104 and cut into pieces, on the skin 108, without affecting its integrity. FIG. 3 also illustrates the interface between the insulative material 104 and the corrugated board consisting of first and second liners 112 and 114 and a fluted medium 120 therebetween. An adhesive layer 118 is provided between the first liner and the layer 108 of the insulative material 104. It is contemplated, within the scope of the present invention, that a foam material may be applied to corrugated board, still hot from the corrugator and that the residual heat would act to bond the foam to the corrugated material without the need for any separate adhesive.

It will be appreciated that insulative materials other than extruded polystyrene and extruded polystyrene with a skin of high impact polystyrene. For example, other foamed polymeric materials such as polyethylene could be used. In addition, materials such as foil could be laminated to the bottom panel of a container according to the present invention. Because foil is water impervious, channel means would be needed and they could entail depressions in the corrugated material of which the bottom panel was comprised. Other insulative materials will occur to those skilled in the art and they are contemplated within the scope of the invention.

The blank 50 shown in FIG. 2 is assembled in the following manner. Side walls 62 and 64 are folded upwardly along fold lines 66 and 68. Reinforcing tabs 76 and 84 are folded along fold lines 80 and 88 towards the front panel 70 which is folded upwardly along fold line 72 and downwardly, in half, along double fold lines 74 until tabs 120 engage slots 122 and the reinforcing tabs 76 and 84 are captured within the front wall of the container. Reinforcing tabs 78 and 86 are folded along fold lines 82 and 90 towards the rear wall 56 which is then folded upwardly along fold line 60. The flaps 92, 94 and 100 of the top panel 52 are folded along fold lines 96, 98 and 102, respectively and the top panel 52 is folded downwardly along fold line 58 to close the container and capture the reinforcing tabs 78 and 86 between the rear wall 56 and the flaps 92 and 94, respectively.

Figure 4:
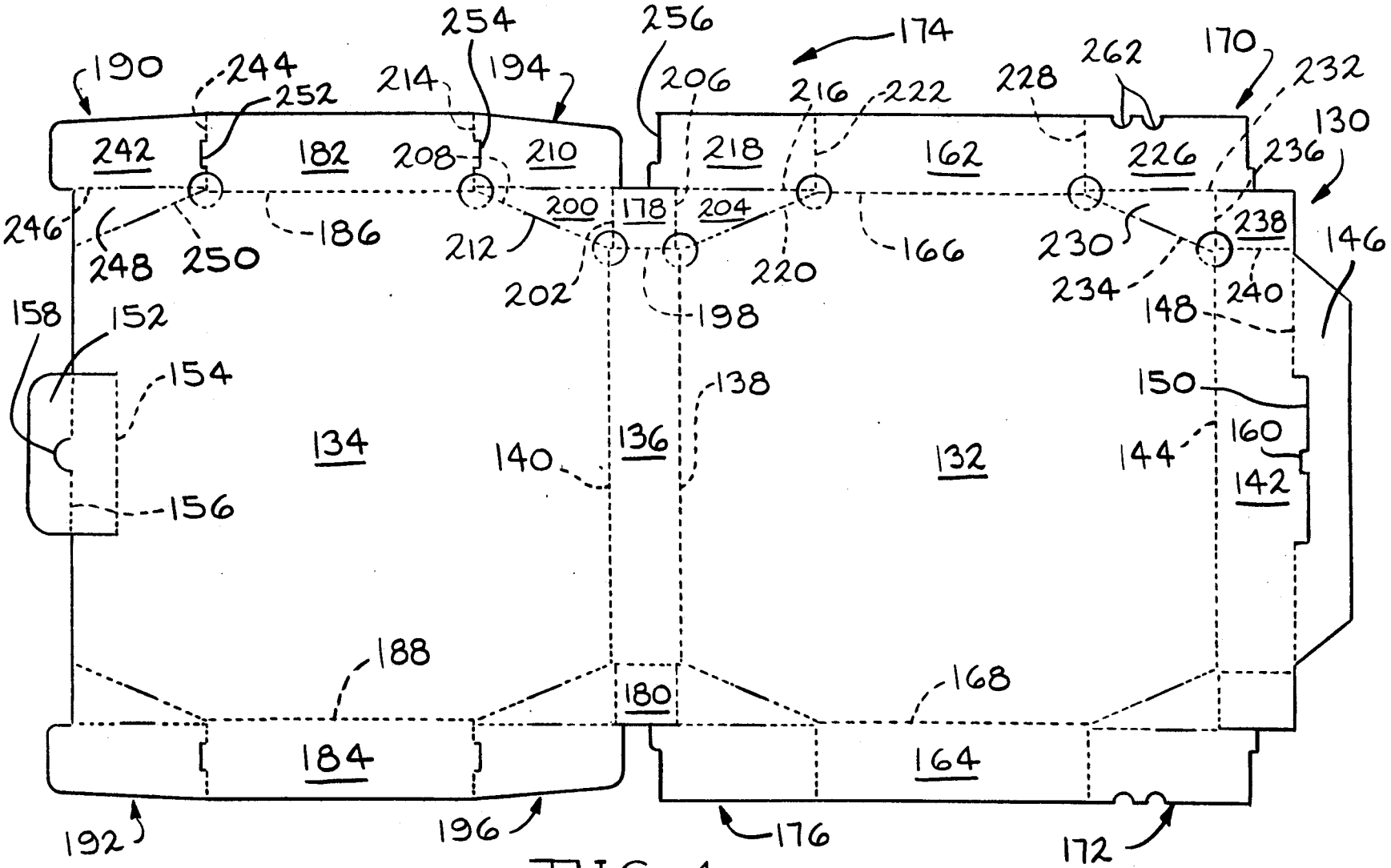
FIG. 4 is a plan view, drawn to scale, of the inside of a blank for a shallow, easy to assemble container, including steam vents.

Referring now to FIG. 4, a blank for producing a container according to a second embodiment of the instant invention is indicated generally at 130. The blank comprises a bottom panel 132, a top panel 134 and a rear wall 136 hingedly connecting the bottom and top panels 132 and 134 along lower and upper fold lines 138 and 140. A front wall 142 is connected to the front edge, defined by fold line 144, of the bottom panel 132. A flap 146, hingedly connected to the front wall 142 along a fold line 148, is slit at 150 to receive a portion of a closure flap 152 which is hingedly connected to the top panel along fold line 154 and includes a fold line 156. A tab 158 is exposed when the flap 152 is folded along the fold line 156. The tab 158 is adapted to engage a cut-out 160 which is exposed when the flap 146 is folded along the fold line 148. This is discussed in more detail in connection with FIG. 6.

Inner side walls 164 are connected to and extend from the bottom panel 132 along fold lines 166 and 168, respectively. Front, inner, diagonal wall structures 170 and 172 are connected to the bottom panel 132 and the side walls 162 and 164, respectively. Rear, inner diagonal wall structures 174 and 176 are connected to the bottom panel 132, the side walls 162 and 164, respectively, and set-up panels 178 and 180, respectively. Outer side walls 182 and 184 are connected to and extend from the top panel 134 along fold lines 186 and 188, respectively. Front, outer, diagonal wall structures 190 and 192 are connected to the top panel 134 and the side walls 182 and 184, respectively. Rear, outer diagonal wall structures 194 and 196 are connected to the top panel 134, the side walls 182 and 184, respectively, and set-up panels 178 and 180, respectively. The blank 130 is symmetrical about its longitudinal axis so side wall 182 corresponds with side walls 184, diagonal wall structure 174 corresponds with diagonal wall structure 176, etc. Accordingly, the following description of the elements in the upper half of FIG. 4 will apply as well to the corresponding elements in the bottom half of FIG. 4.

Set-up panel 178 is connected to one end of the rear wall 136 along fold line 198. Set-up panel 178 is also connected to an outer rear coupling panel 200 along fold line 202, and an inner rear coupling panel 204 along fold line 206. Outer rear coupling panel 200 is, in turn, connected along fold line 208 to an outer rear diagonal wall panel 210 and these elements together constitute the outer rear diagonal wall structure 194. The outer rear coupling panel 200 is connected along fold line 212 to the top panel 134 and the outer rear diagonal wall panel 210 is connected along fold line 214 to the outer side wall 182.

Similarly, inner rear coupling panel 204 is connected along a fold line 216 to an inner rear diagonal wall panel 218 and these elements together constitute the inner rear diagonal wall structure 174. The inner rear coupling panel 204 is connected along fold line 220 to the bottom panel 132 and the inner rear diagonal wall panel 218 is connected along fold line 222 to the inner side wall 162.

Figure 5:
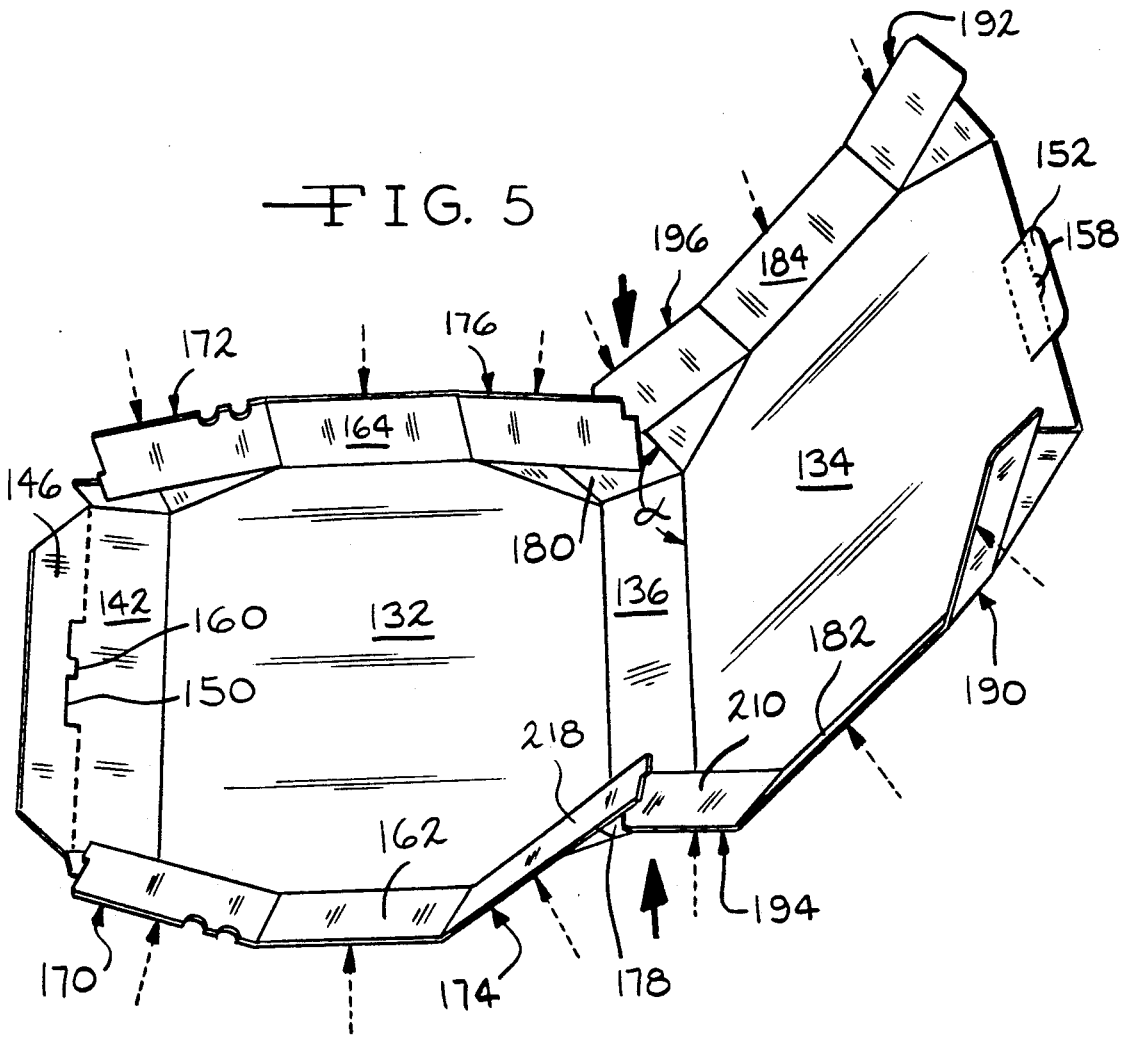
FIG. 5 is a perspective view of the blank shown in FIG. 4, during set-up.
Figure 6:
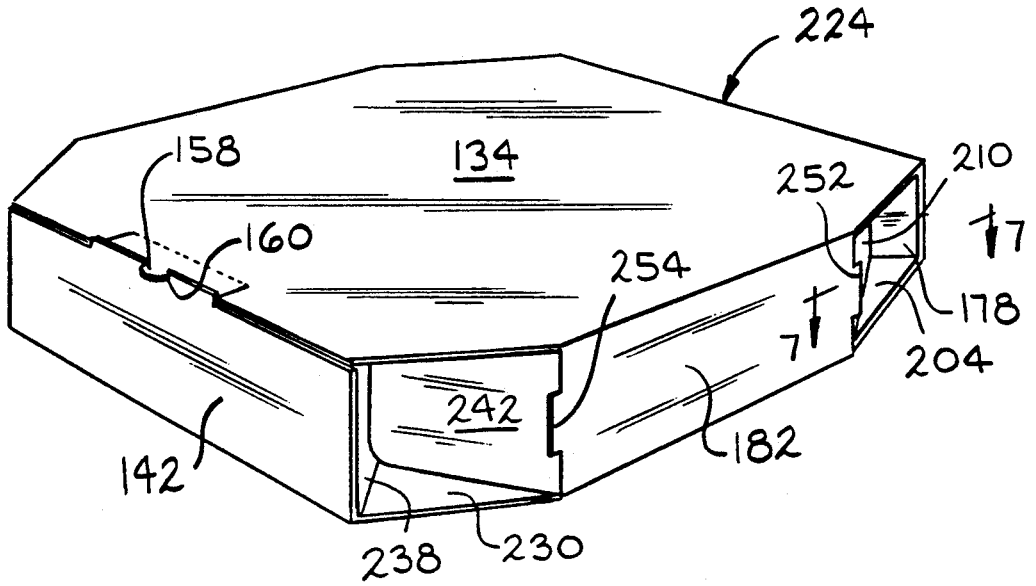
FIG. 6 is a perspective view of a fully closed container set-up from the blank shown in FIGS. 4 and 5.

The illustrated blank 130 is self erecting in the sense that, the action of folding or pivoting the set-up panel 178 upwardly about the fold line 198 and similarly folding the set-up panel 180 about the fold line corresponding with 198 (this is represented in FIG. 5 by bold arrows), assuming a condition where the bottom is anchored, for example, by the weight of a payload (not shown) resting on the bottom panel 132, will create the reactions represented in FIG. 5 by arrows with dotted tails. The initiation of the reactions represented in FIG. 5 can be facilitated by combining inward and upward pressure on the set-up panels 178 and 180 with a slight lifting force exerted on the top panel 134. Once the reactions begin, however, the lifting force is not required to sustain the reactions represented by the arrows with dotted tails. Continued pressure on the set-up panels 178 and 180 in the direction of the bold arrows will sustain the reactions. When the set-up has progressed a little beyond the point illustrated in FIG. 5, an angle o between the rear wall 136 and the set-up panel 180, and a corresponding angle between the rear wall 136 and the set-up panel 178, will be less than 90°. At that point, rapid and sure closure of the blank can be effected by squeezing together the set-up panel 180 and the rear wall 136 on the one side and the set-up panel 178 and the rear wall 136 on the other side. This squeezing action can be utilized to bring the diagonal wall structures 190 and 192 down around the diagonal wall structures 170 and 172 at which time the closure means can be utilized to fasten closed the erected container 224 as shown in FIG. 6. In this embodiment, fastening is effected by inserting the closure flap 152 through the slit 150 and engaging the tab 158 in the cut-out 160. Other means for fastening the container 224 in a closed position can be utilized, of course, and one example of other fastening means will be discussed below in connection with FIGS. 10 and 11. Other fastening means will be discussed below with reference to FIGS. 12–16. First, additional features of the blank 130 will be discussed with reference to FIGS. 4, 5 and 6.

The top panel 134 and associated elements are sized, relative to the bottom panel 132 and associated elements so that, during the set-up described above in connection with FIGS. 5 and 6, the outer side walls 182 and 184 are guided by the reactions to be outside of the inner side walls 162 and 164 in the set-up container 224. So too are the outer, rear diagonal wall panel 210 and the corresponding outer, rear diagonal wall panel guided to be outside of the inner, rear diagonal wall panel 218 and the corresponding inner rear diagonal wall panel, in the set-up container 224. Specifically, the top panel 134 is sized to be slightly larger than the bottom panel 132 and the inner rear coupling panel 204 is slightly longer along the fold line 216 than is the outer rear coupling panel 200 along the fold line 208. In addition, there are several offsets between adjacent fold lines and these are circled. The amount of offset in each case is between approximately one sixteenth (1/16) and one eighth (⅛) of an inch. The amount of offset in a particular location is not critical, nor is the amount by which the top panel 134 and the coupling panel 204 are larger than bottom panel 132 and coupling panel 200, so long as they are controlled to produce the reactions described above in connection with FIG. 5.

Referring again to FIG. 4, the inner diagonal wall structure 170 of the blank 130 comprises an inner front diagonal panel 226 connected to and extending from the inner side wall 162 along a fold line 228. The diagonal panel 226 is also connected to an inner coupling panel 230 along a fold line 232. The coupling panel 230 is also connected, along a fold line 234, to the bottom panel 132, and is connected, along a fold line 236, to a reverse, inner, diagonal wall panel 238. The wall panel 238 is connected, along a fold line 240, to the front wall 142. The front, outer diagonal wall structure 190 comprises a front, outer diagonal wall panel which is connected along a fold line 244 to the outer side wall 182, and is connected, along a fold line 246, to a front, outer coupling panel 248. The coupling panel is also connected, along a fold line 250, to the top panel 134. The set-up described above in connection with FIG. 5 creates reactions in the components of the top and bottom front diagonal wall structures and the reactions are represented in FIG. 5 by arrows with dotted tails.

Figure 7:
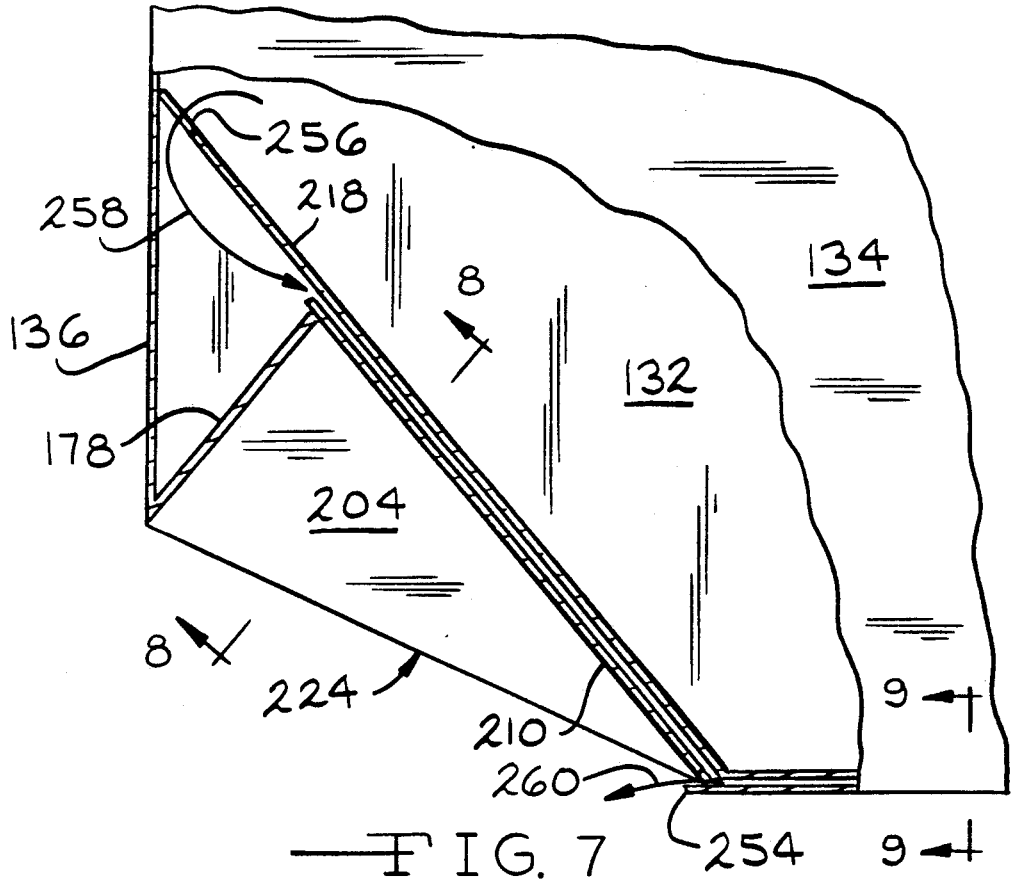
FIG. 7 is a sectional view taken along the line 7—7 of FIG. 6.
Figure 8:
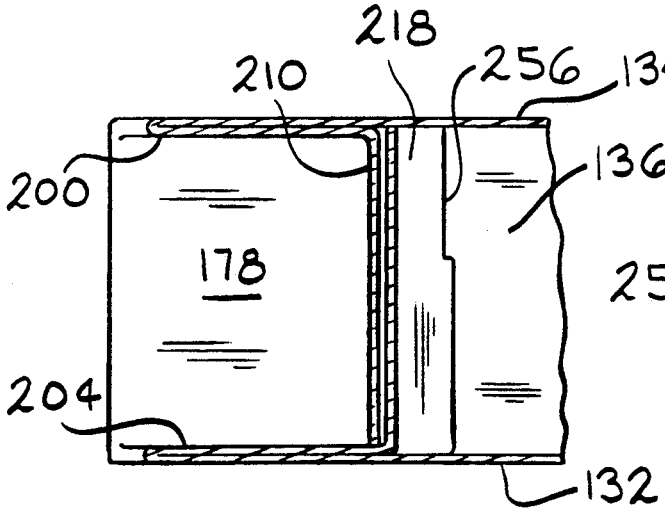
FIG. 8 is a sectional view taken along the line 8—8 of FIG. 7.
Figure 9:
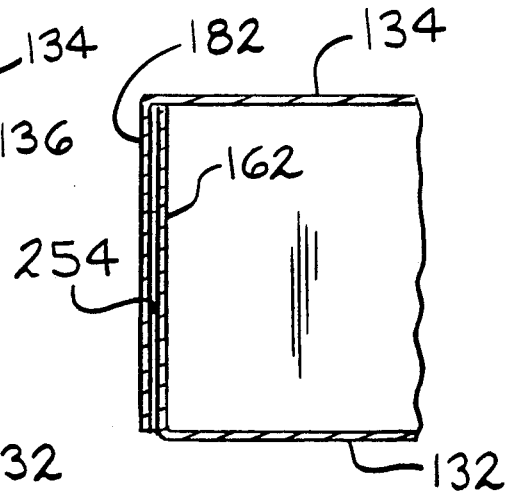
FIG. 9 is a sectional view taken along the line 9—9 of FIG. 8.

At opposite ends of the outer side wall 182, there are provided vent slots 252 and 254. One or both of the vent slots 252 and 254 may be provided to allow hot moist air to escape from between the outer, front diagonal wall panel 242 and the inner, front diagonal wall panel 226. Hot moist air is vented from the inside of the container 224 through an opening defined the rear wall 136 and a cut out 256 provided on the inner, rear diagonal panel 218. This relationship is better illustrated in FIG. 7 where the flow of hot moist air out of the inside of the container 224 is represented by an arrow 258. The hot, moist air is vented to the atmosphere by passing between the panels 210 and 218 and escaping, as represented by an arrow 260, through the vent slot 254. This flow of air between the panels 210 and 218 will transfer heat to and raise the temperature of the outside of panel 218, consequently reducing the rate at which heat is transferred through the panel 218. Thus, the illustrated vent arrangement uses hot moist air to transfer heat to the panel 218 and thereby reduce the rate at which heat is lost from inside the container 224. Similarly, vents 262 will vent hot, moist air from inside the container 224 to flow between the panels 226 and 242 and out from between these panels through the vent slot 252.

Figure 10:
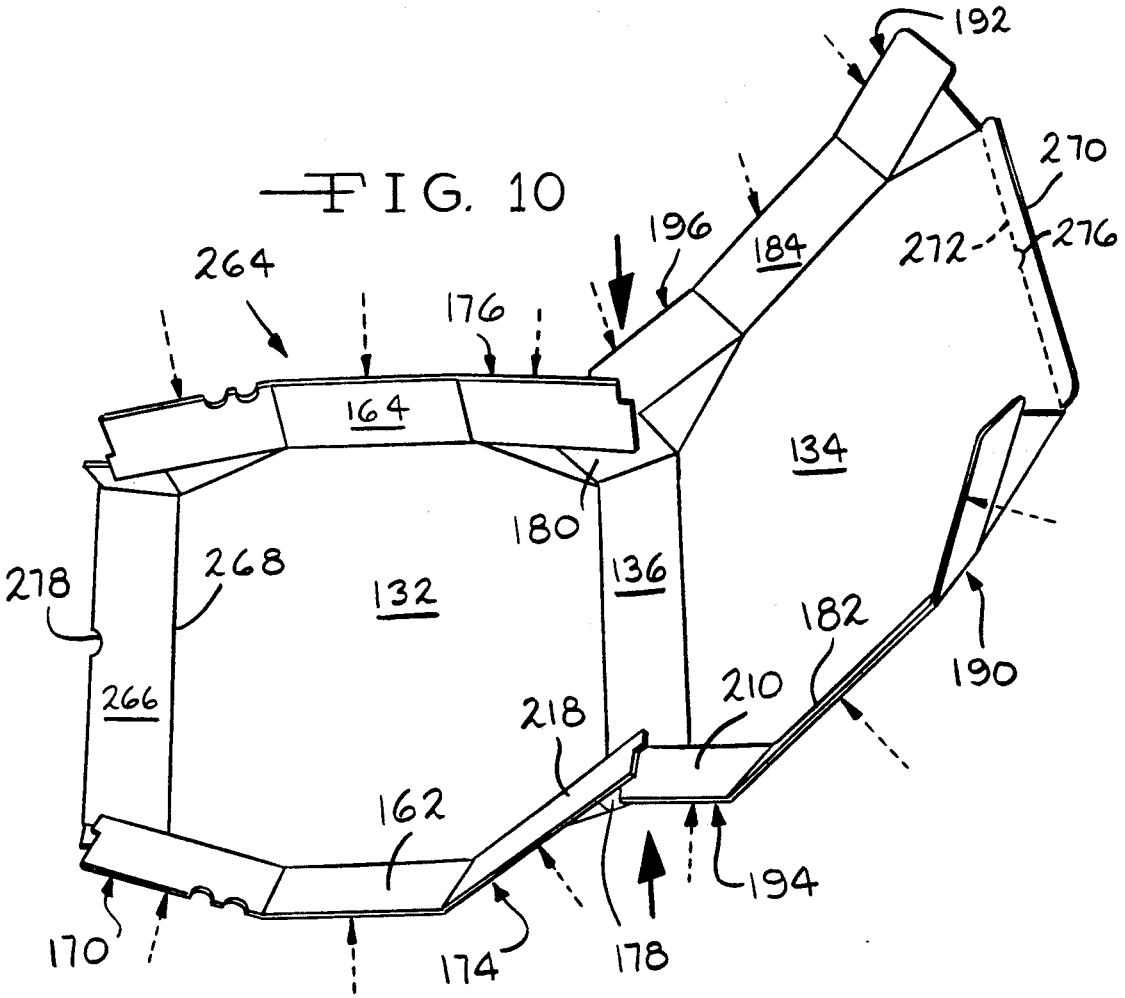
FIG. 10 is a perspective view of a blank, during set-up, which blank is similar to the blank illustrated in FIG. 5.
Figure 11:
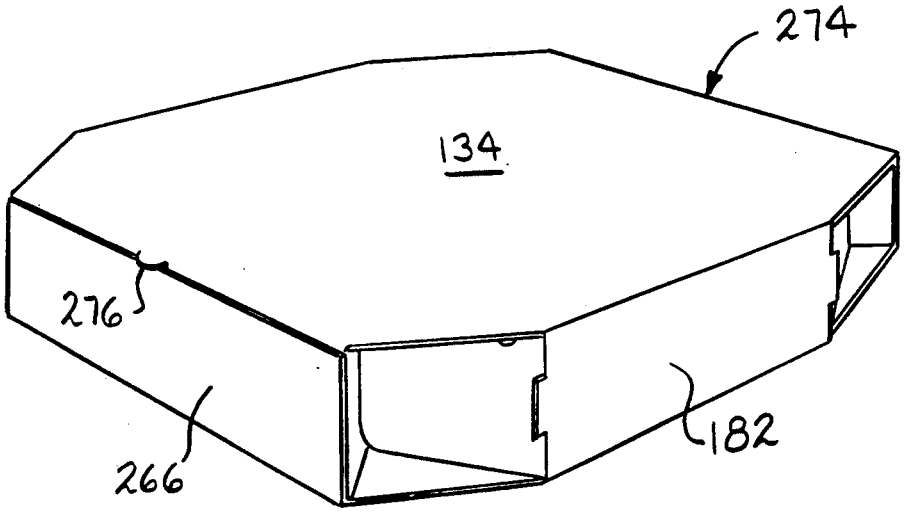
FIG. 11 is a perspective view of a fully closed container set-up from the blank shown in FIG. 10.

FIGS. 10 and 11 illustrate a blank 264 corresponding with the blank 130 except for the details of construction of the means for fastening the blank 264 in a closed position. Specifically, a front wall 266 is connected, along a fold line 268, to the bottom panel 132. A closure flap 270 is connected to the top panel 134 along a fold line 272. The flap is received between the front wall 266 and the reverse, front diagonal panel 238, on one side and the corresponding reverse, front diagonal panel on the other side, thereby fastening the container 274 closed. Additional fastening is provided by a tongue 276 which is received in a cut-out 278.

Figure 12:
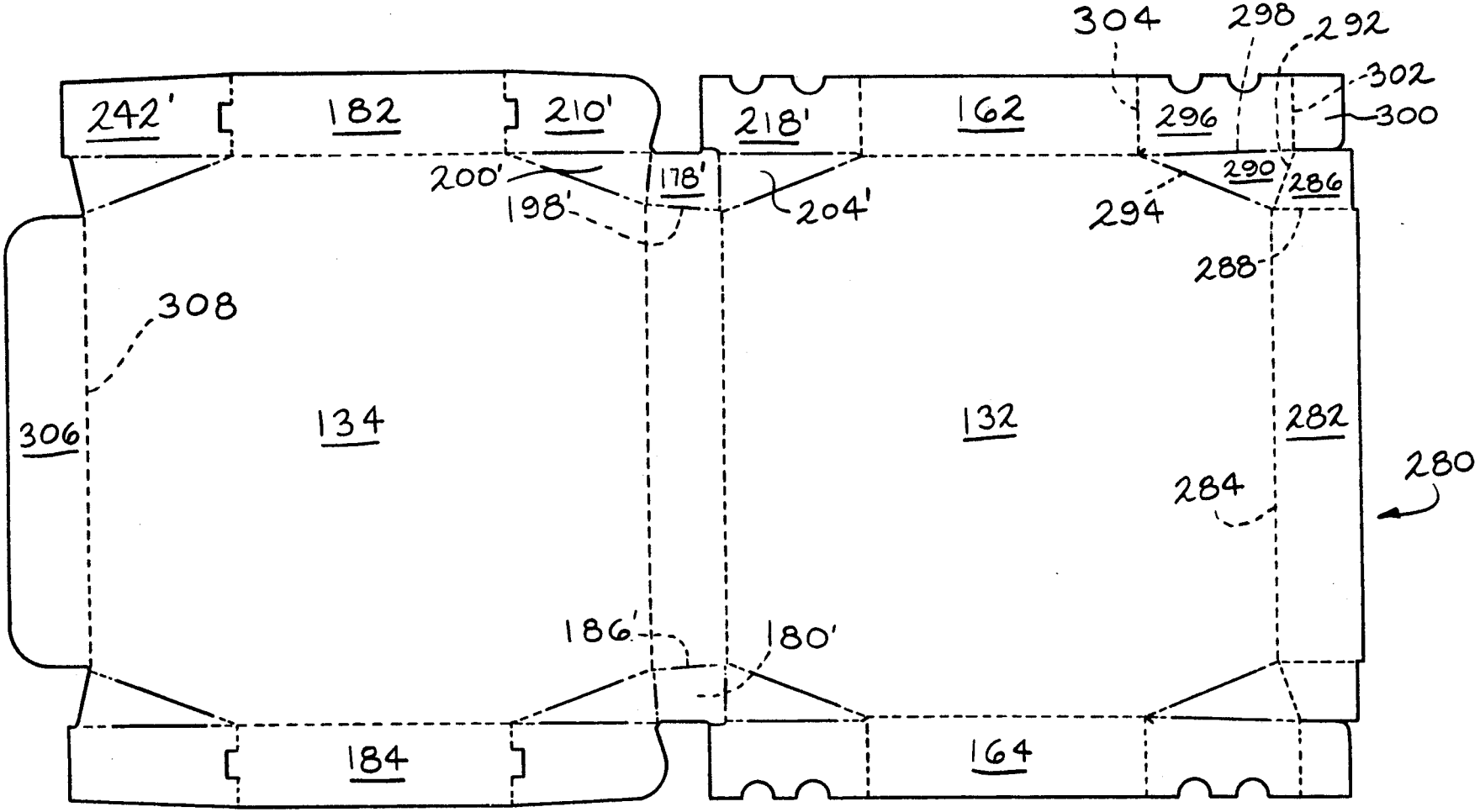
FIG. 12 is a plan view, drawn to scale, of the inside of a blank for a shallow container, which blank is similar to the blank shown in FIGS. 4, but includes improved front panel closure means.

Referring now to FIG. 12, a blank 280 corresponds generally with blanks 130 and 264, but has an entirely different arrangement for fastening closed a box produced from the blank 280. The blank also includes improved front corner structures. A front wall 282 is hingedly connected to bottom panel 132 along a fold line 284. The front wall is also hingedly connected to a locking reverse front diagonal panel 286 along a fold line 288. The panel 286 is also hingedly connected to a coupling panel 290 along a fold line 292. The coupling panel 290, in turn, is hingedly connected to the bottom panel 132 along fold line 294 and also to a front diagonal panel 296 along a fold line 298. A locking tab 300 is hingedly connected to the front diagonal panel 296 along a fold line 302. The front diagonal panel 296 is also hingedly connected to side wall 162 along a fold line 304. A closure flap 306 is hingedly connected to top panel 134 along a fold line 308.

There are some additional differences between the blank 280 and the blanks 130 and 264. Some of these other differences are differences of form, where the function of the element in the blank 280 is the same as or similar to the function of a corresponding element in the blanks 130 and 264. Some of the elements of the blank 280 which differ in form from those corresponding elements of the blanks 130 and 264 are identified by the corresponding element's reference numeral followed by a prime mark. Thus, the blank 280 includes an outer rear diagonal panel 210' which has a different shape than the outer rear panel 210 in the blanks 130 and 264, but nonetheless functions like the panel 210, as described in connection with FIGS. 4 through 11.

Figure 13:
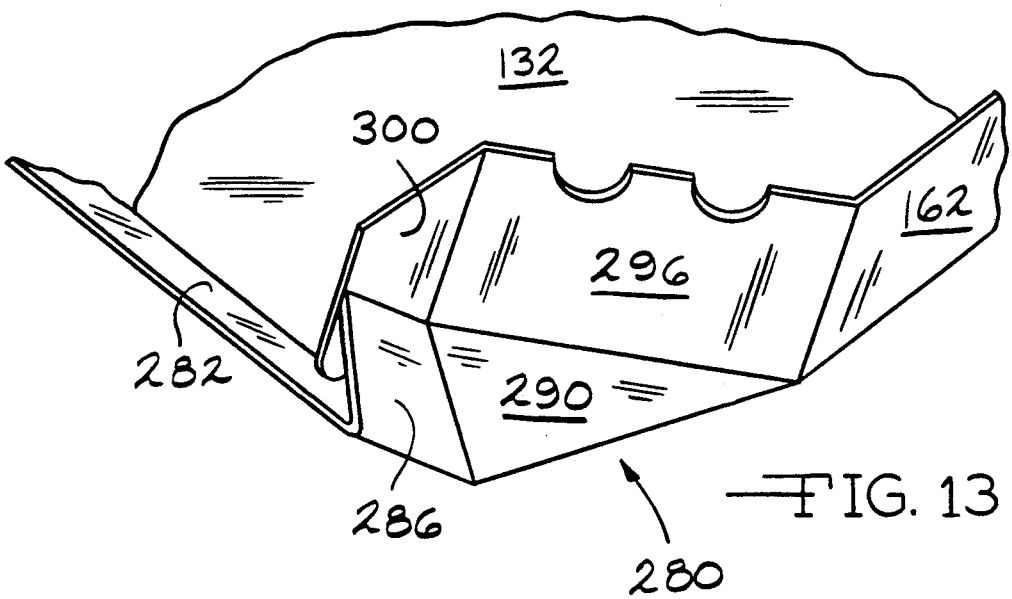
FIG. 13 is a perspective view of a portion of the blank shown in FIG. 12, during initial engagement of front locking tabs.
Figure 14:
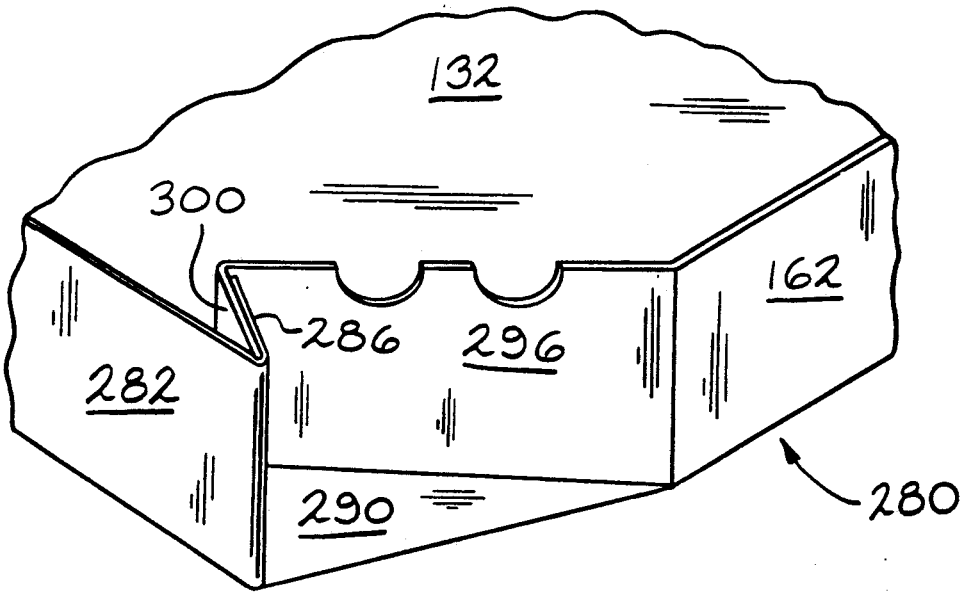
FIG. 14 is a perspective view of the portion of the blank shown in FIG. 13 after engagement of a corner locking tab.

The blank 280 is set-up, initially, by folding the front panel 282 upwardly and folding the reverse front diagonal panel 286 and the coupling panel 290 inwardly, as illustrated in FIG. 13. As set-up continues, the locking tab 300 is manually turned outwardly so as to position it between the reverse front diagonal panel 286 and the front panel 282. At least a portion of the locking tab 300 extends all the way to the intersection of the front panel 282 and the reverse diagonal panel 286, as shown in FIG. 14. It will be appreciated that the same set-up procedure would be applied to the panels and tabs at the end of the front panel 282 opposite from the one illustrated in FIGS. 13 and 14, to produce the arrangement illustrated on the left side of FIG. 15. The locking tabs 300 give the front panel 282, the reverse front diagonal panels 286, the diagonal panels 296 and the side walls 162 and 164 remarkable support so that they can retain the relative positions illustrated for them in FIG. 15.

Figure 15:
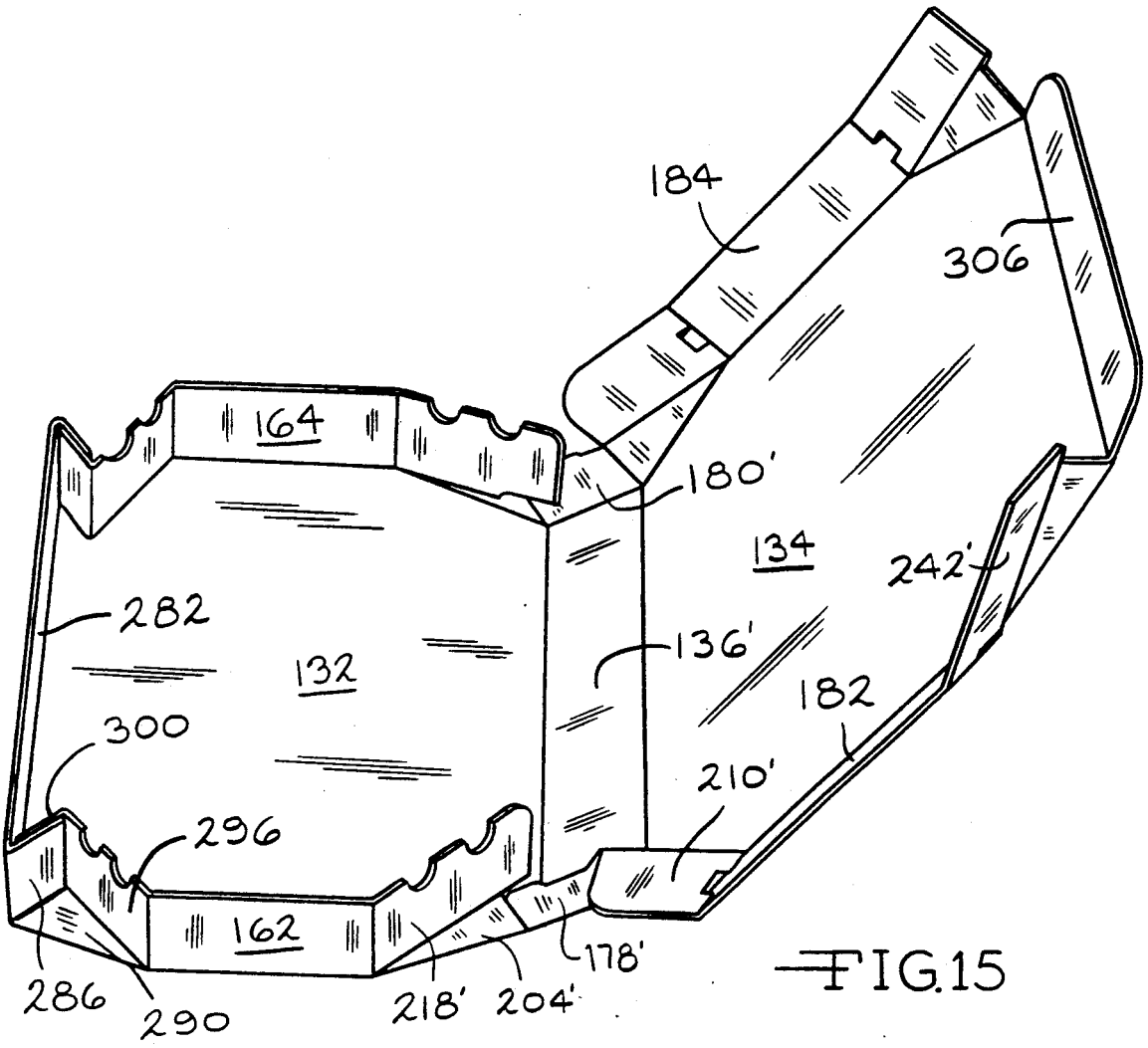
FIG. 15 is a perspective view of the FIG. 12 blank after the front has been set-up and set-up of the rest of the container has begun.
Figure 16:
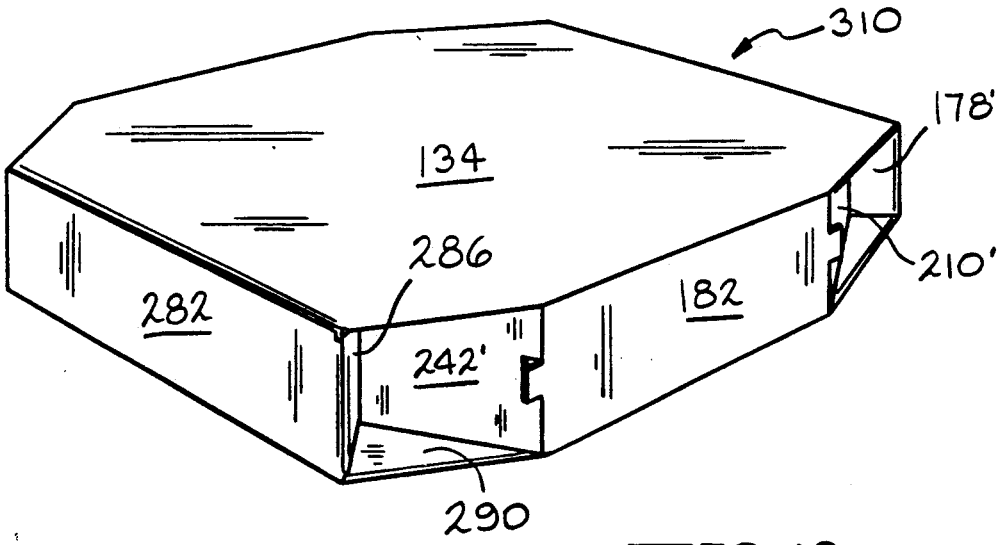
FIG. 16 is a perspective view of the container blank shown in FIGS. 12–15, in a fully assembled and closed condition.

With further reference to FIG. 15, set-up has proceeded as the set-up panels 178' and 180' have been folded inwardly and the top panel 134 has been lifted. From this stage of set-up, the top panel 134 is pivoted about the rear wall 136' to a nearly closed position and the closure flap 306 is inserted between the front wall 282 and the locking tab 300 to produce a closed container 310 as shown in FIG. 16. The width of the flap 306 is controlled so that it will be frictionally engaged between the front wall 282 and the locking tab 300.

Figure 17:
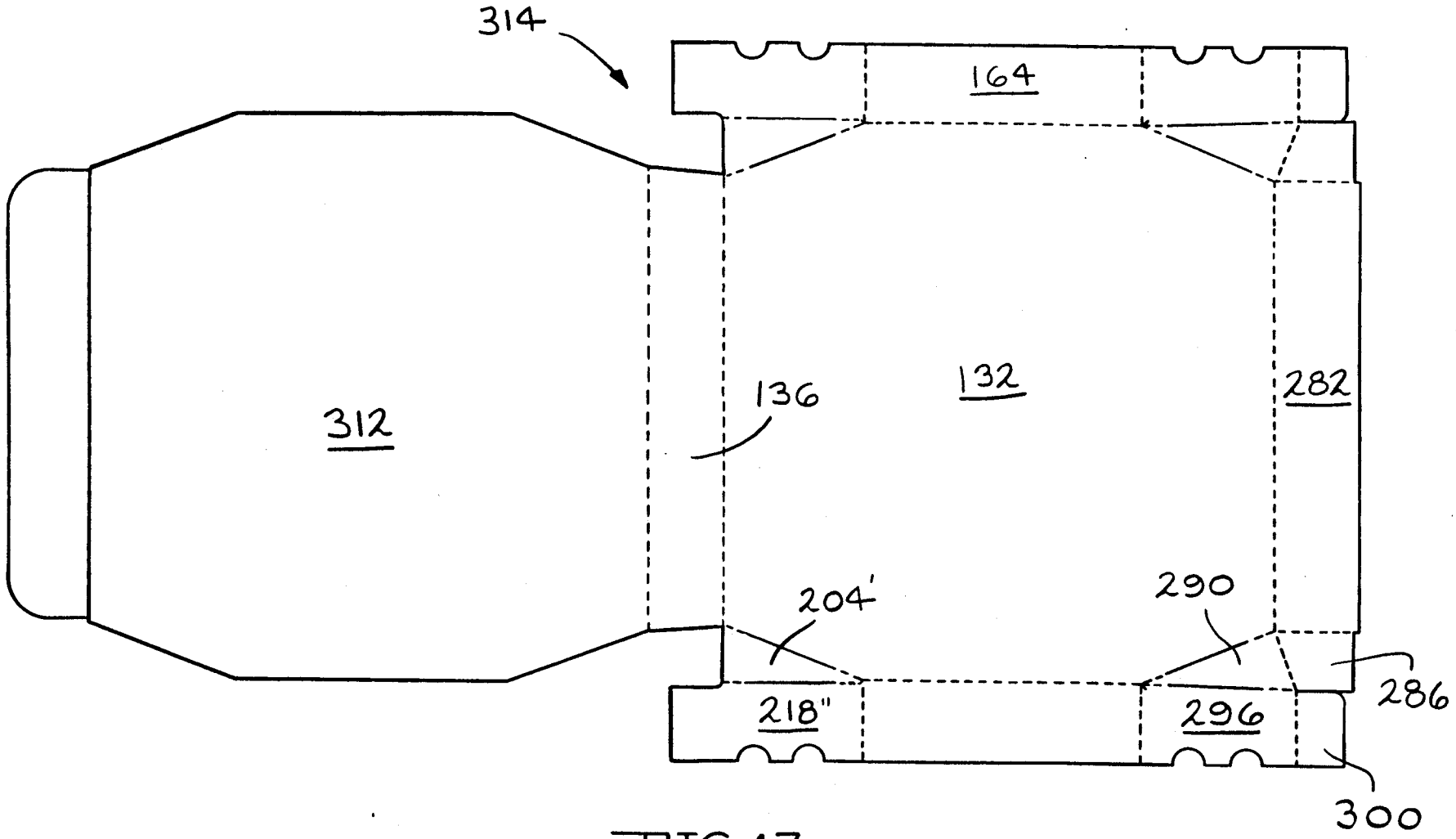
FIG. 17 is a plan view of a blank with a bottom similar to the blank shown in FIG. 12, and a simple top.

It will be appreciated that a variety of top panel configurations can be substituted for the configuration of the top panel 134. A suitable top 312 is illustrated in FIG. 17 in association with a blank 314 for producing a single side wall container. Other than the top 312 and the lack of set-up panels, the blank 314 corresponds with the blank 280. The closure flap 306 is connected to the top 312 and is receivable between the front panel 282 and the locking tabs 300. Frictional engagement of the closure flap 306 between the front panel 282 and the locking tab 300 will give a container set-up from the blank 314 excellent rigidity and strength. It is to be noted that rear diagonal side walls 218'' are longer than corresponding diagonal side walls 218' and 218 so that the rear diagonal side walls 218'' will extend to the rear wall 136 in a container set-up from the blank 314. Alternatively, the rear diagonal side walls 218'' could be the same length as the rear diagonal side walls 218' and 218, if set up panels (not shown) corresponding with set-up panels 178 and 180 or 178' and 180' were provided on the blank 314.

Figure 18:
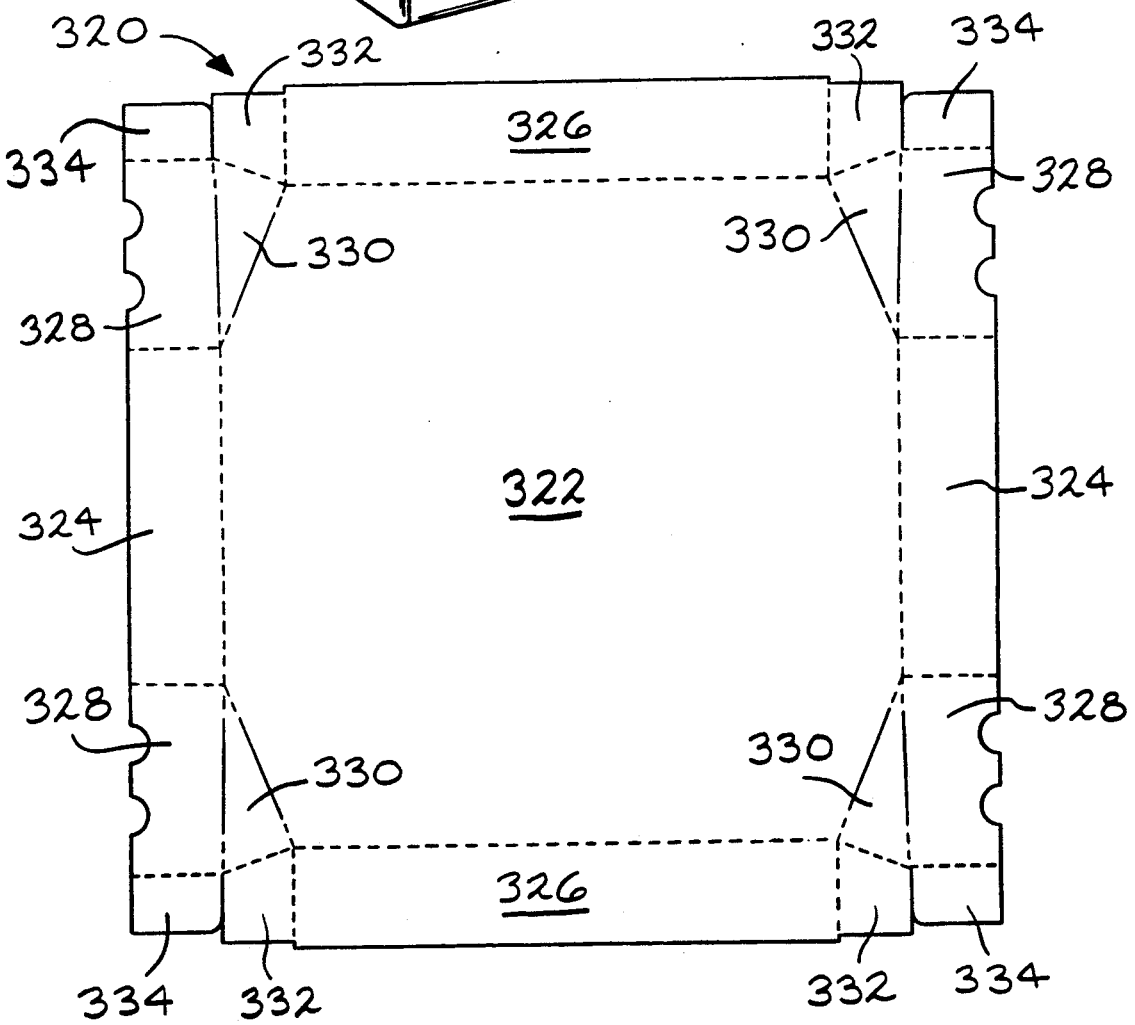
FIG. 18 is plan view of a blank, drawn to scale, for producing a tray with corners including locking tabs.

Referring now to FIG. 18, a blank for producing a topless container or tray is indicated generally at 320. The blank comprises a bottom panel 322, a pair of opposed side walls 324 connected to the bottom panel 322, and two opposed end walls 326 connected to the bottom panel 322. Four diagonal side wall panels 328 are provided, one being connected to each end of each side wall 324. The diagonal side wall panels 328 are also connected to coupling panels 330 which are connected, in turn, to the bottom panel 322. To each end of each end wall 326, there is connected a reverse diagonal side wall 332 which, in turn, is connected to the adjacent coupling panel 330. Finally, a locking tab 334 is connected to each of the diagonal side wall panels 328, opposite the connection thereof to the side walls 324.

Set-up of the blank 320 is carried out by manipulating the end walls 326 and the associated structures, substantially as described above for the front wall 282 and associated structures, with reference to FIGS. 13 and 14. Specifically, the end walls 326 are folded upwardly as the adjacent reverse diagonal side walls 332 and the coupling panels 330 are folded upwardly and inwardly. As set-up progresses, the locking tab 334 is inserted between the adjacent end wall 326 and reverse diagonal side wall 332.

If desired, a simple top (not shown) can be hingedly connected to one of the side walls 324 or one of the end walls 326. It would be preferred to connect a top to one of the end walls 326 so that a portion of such a top can be received between the opposed end wall 326 and the adjacent locking tabs 334.

Figure 19:
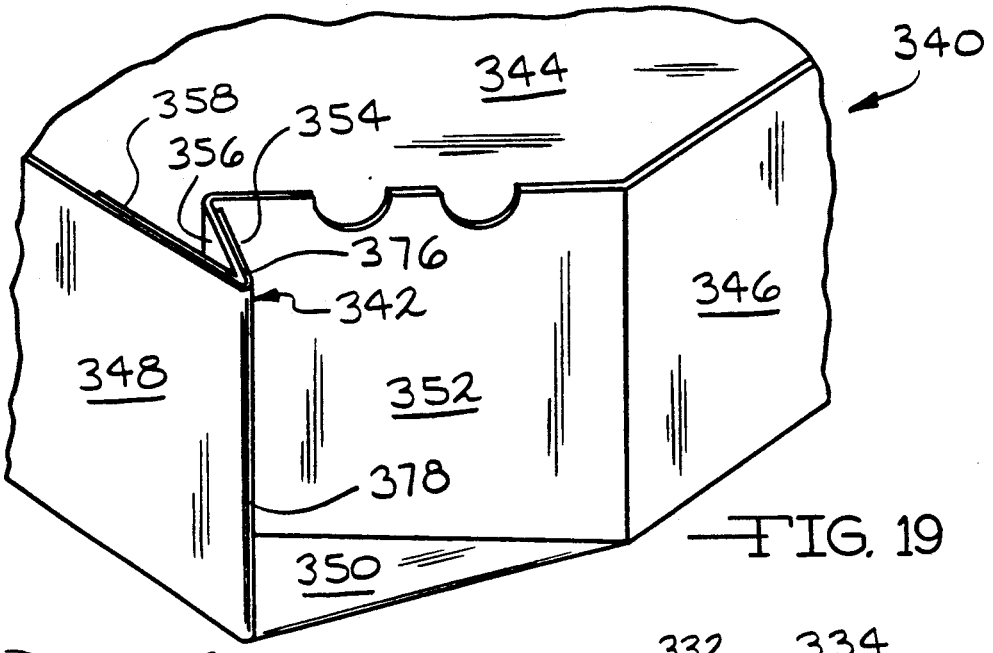
FIG. 19 is a perspective view of a corner structure including a locking tab and a reverse locking tab.

Referring now to FIG. 19, a portion of a container, indicated generally at 340, includes a corner structure, indicated generally at 342, with a modified locking tab arrangement. The container 340 comprises a bottom panel 344, side wall 346 and front or end wall 348. A coupling panel 350 is connected to the bottom panel 344 and is also connected to a diagonal side wall panel 352 and a reverse diagonal side wall panel 354. The diagonal side wall panel 352 is connected to the side wall 346 and the reverse diagonal side wall panel 354 is connected to the front or end wall 348. A first locking tab 356 is connected to and extends from the diagonal side wall panel 352. A second locking tab 358 is connected to and extends from the first locking tab 356. The first locking tab 356 extends from the diagonal side wall panel 352 a distance corresponding with the width of the reverse diagonal side wall panel 354. The first locking tab 356 and the second locking tab 358 extend from the diagonal side wall panel a combined distance corresponding approximately with the depth of the side wall 346 and the front or end wall 348. Accordingly, from the standpoint of reducing scrap in producing blanks, the double locking tab configuration is well suited to relatively deep containers while the single tab configuration is well suited to relatively shallow containers. Additionally, more rigidity and corner strength is usually desirable in deeper containers and the double locking tab configuration provides such rigidity and corner strength.

Figure 20:
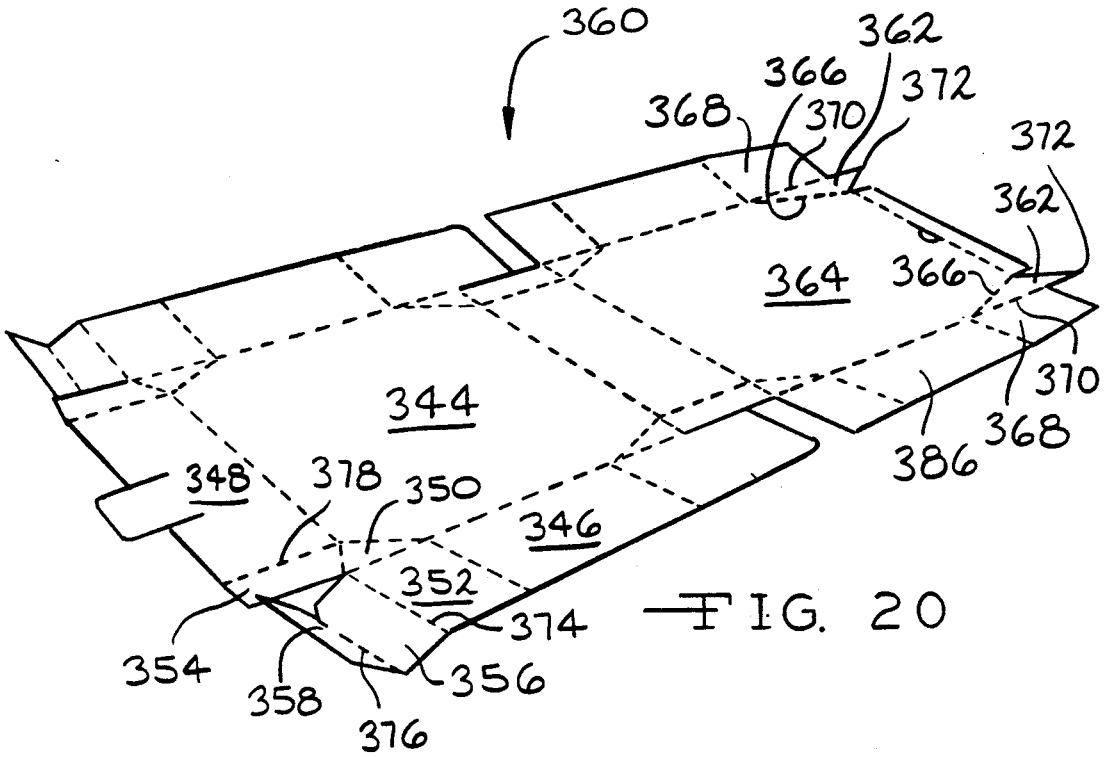
FIG. 20 is a perspective view of a container blank for producing a deep, double walled container including corner structures of the type illustrated in FIG. 19.

A blank for producing a container including the corner structure 340 is indicated generally at 360 in FIG. 20. The blank 360 corresponds in many ways with the blank 280 illustrated in FIG. 12. One difference resides in front outer coupling panels 362 which are connected to a top panel 364 along score lines 366. The coupling panels 362 are also connected to outer, front diagonal wall panels 368 along score lines 370. The coupling panels include tab means 372 which function in a manner which is described below with reference to FIG. 21.

Assembly of the blank 360 begins with "breaking" the blank 360 along score lines 374 which separate the first and second locking tabs 356 and 358, and also along score lines 376 which separate the inner side walls 346 and the first locking tabs 356, as shown in FIG. 20. The second locking tabs 358 are folded against the first locking tabs 356 and, together, they are folded upwardly and inwardly towards the center of the blank 360. This causes a reaction through the coupling panels 350 which in turn causes the front wall 348 to fold upwardly and causes the reverse diagonal side wall panel 354 to fold over towards the front wall 348. The first and second locking tabs are then positioned between the front wall 348 and the reverse diagonal side wall panel 354, thereby aligning the score line 376 with a score line 378 which separates the front wall 348 from the reverse diagonal side wall panel 354, substantially as shown in FIG. 19. Set-up of the blank 360 proceeds in the manner described above for blank 280 with reference to FIG. 15.

Figure 21:
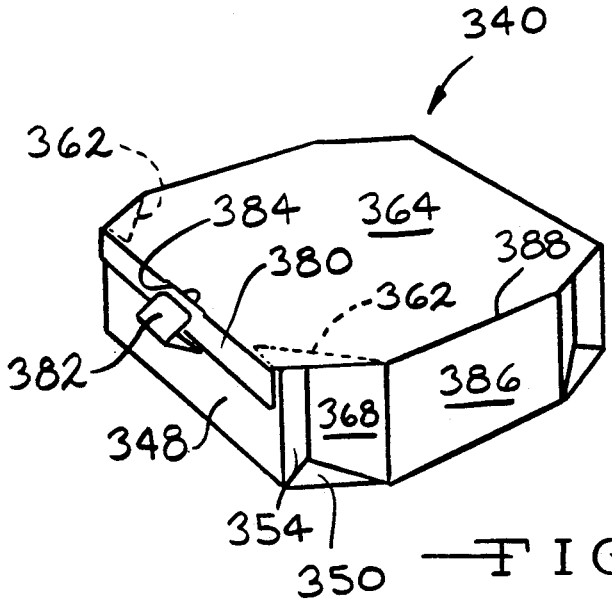
FIG. 21 is a perspective view of a container produced from the blank illustrated in FIG. 21.

Referring now to FIG. 21, the container set-up from the blank 360 is indicated generally at 340. A closure flap 380 is positioned adjacent to and outside the front wall 348. A locking closure tab 383 depends from the front wall 348 and is positioned to be inserted in a slot, indicated at 384, formed between the closure flap 380 and the top panel 364. When received in the slot indicated at 384, the locking closure tab 382 maintains the top panel in a closed position, as illustrated in FIG. 21.

With the container 340 in the closed position illustrated in FIG. 21, the tab means 370 of the coupling panels 362 are locked between upper edges of the reverse diagonal side wall panel 354 and the first locking tabs 356, on the one hand, and the top panel 364, on the other hand. This locked condition prevents outer side walls 386 from being deflected outwardly and pivoting about score lines 388 which separate the side walls 386 from the top panel 364. Specifically, with the tab means 370 held captive, outward deflection of the adjacent outer, front diagonal wall panels 368 is resisted because the tab means 370 and the outer, front diagonal wall panels 368 are both connected to the coupling panels 362. The outer side walls 386 are in turn connected to the outer, front diagonal wall panels 368. Accordingly, if one grasped the outer side walls 386 and picked up the closed container 340 illustrated in FIG. 21, the side walls 386 would be positively maintained in the positions illustrated for them, even if there was a substantial payload in the container 340.

It will be appreciated that the container 340 can be provided with vents such as those discussed above, particularly with reference to FIGS. 5-9, to channel warm air from inside the container and between side walls to reduce the rate at which heat is transferred from inside the container. Similarly, the container 340 can be provided with one or more insulative layers in accordance with the features discussed above in connection with FIGS. 1-4.

Figure 22:
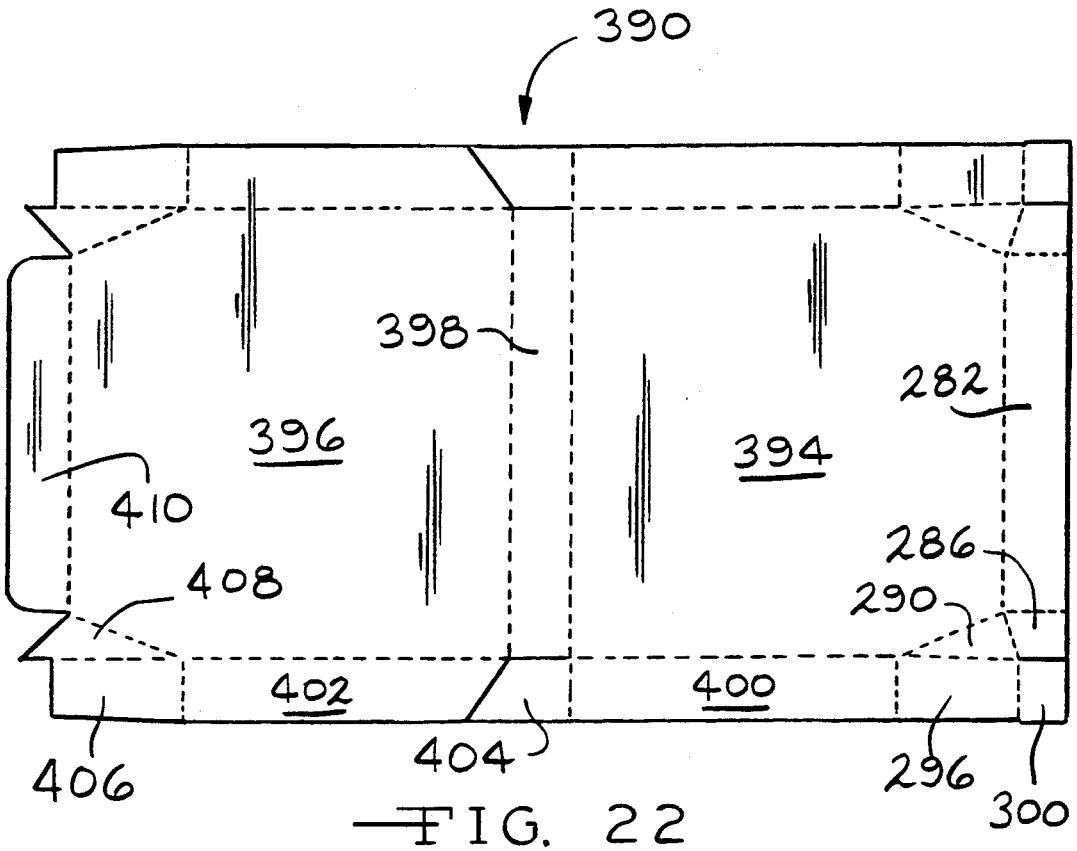
FIG. 22 is a plan view of an integral prescored blank for producing a six-sided container with front corner structures including locking tabs.
Figure 23:
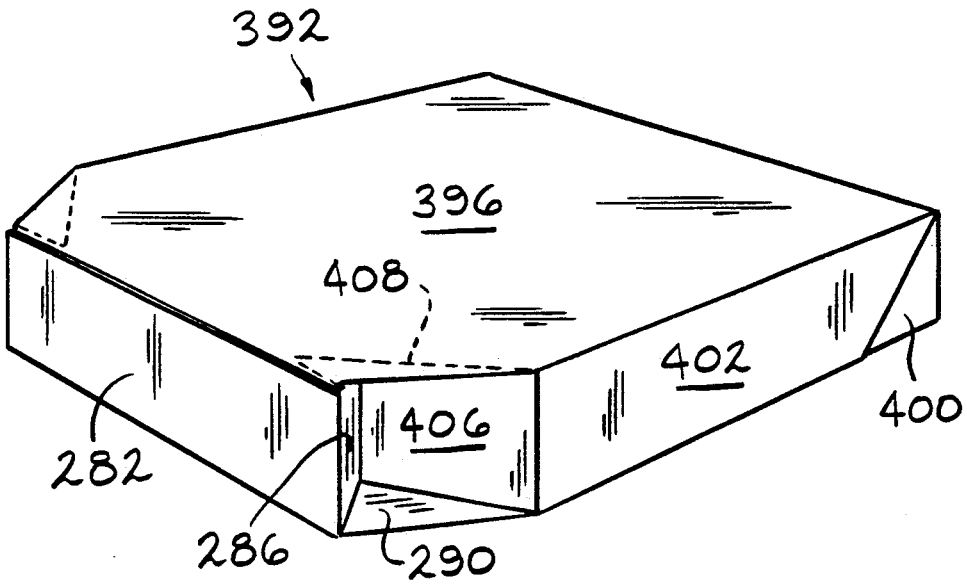
FIG. 23 is a perspective view of a six sided container produced from a blank corresponding with the one illustrated in FIG. 22.

Referring now to FIGS. 22 and 23, a blank for producing a six-sided container is indicated generally at 390 in FIG. 22 and a six-sided container produced therefrom is indicated generally at 392 in FIG. 23. The blank 390 is cut and scored to define a bottom panel 394, a top panel 396 and a rear or hinged wall 398 hingedly connecting the top and bottom panels 396 and 394. Inner side walls 400 are connected to and extend from the bottom panel 394 and outer side walls 402 are connected to and extend from the top panel 396. The blank 390 includes front corner structures similar to those discussed above, particularly in connection with FIGS. 12-15, and like reference numerals have been applied to corresponding elements. Specifically, the blank 390 includes a front wall 282 hingedly connected to the bottom panel 394. The front wall 282 is also hingedly connected to a locking reverse front diagonal panel 286. The panel 286 is hingedly connected to a coupling panel 290. The coupling panel 290, in turn, is hingedly connected to the bottom panel 394 and also to a front diagonal panel 296. A locking tab 300 is hingedly connected to the front diagonal panel 296. The front corner structures in the blank 390 are set-up in the manner illustrated in FIGS. 13 and 14.

Reinforcing tabs 404 are connected to and extend from the inner side walls 400. The tabs 404 are disconnected from the rear wall 398 and from the outer side walls 402. After the front corner structures are set-up, the reinforcing tabs 404 are folded inwardly. Outer, front diagonal wall panels 406, which are connected to the outer side walls 402 and to coupling panels 408, are folded over so that each of the coupling panels is adjacent to the top panel 396. At this stage, the top panel is folded over and a 368 and a closure flap 410, which is connected to and extends from the top panel 396, is inserted between the front wall 282 and the locking tab 300 where it is frictionally engaged. The set-up box 392 is illustrated in FIG. 23. The coupling panels 408, shown in hidden lines in FIG. 23 are held captive between the locking tab 300 and the locking reverse front diagonal panel 286, on the one hand, and the top panel 396 on the other hand.

One distinct benefit obtained with blanks 280 (FIG. 12), 314 (FIG. 17), 360 (FIG.20) and 390 (FIG. 22) is significantly reduced material usage and, therefore, cost. The height of the front wall or panel 282 (FIGS. 12, 17 and 22) and the height of the front wall 348 (FIG. 20) are less than half of the height of the front panel 70 (FIG. 2) of blank 50. Consequently, a box produced from blanks corresponding with blanks 280 (FIG. 12), 314 (FIG. 17), 360 (FIG.20) and 390 (FIG. 22) will require less material than the same size box if it was produced from a blank corresponding with blank 50 (FIG. 2). Nonetheless, the corner structures in the blanks 280 (FIG. 12), 314 (FIG. 17), 360 (FIG.20) and 390 (FIG. 22) produce boxes with exceptional strength and rigidity in the front wall or panel 282 (FIGS. 12, 17 and 22) and the front wall 348 (FIG. 20), despite the fact that such front walls are a single thickness as compared with the double thickness of the front wall produced from the front panel 70 in the blank 50 (FIG. 2).

Figure 24:
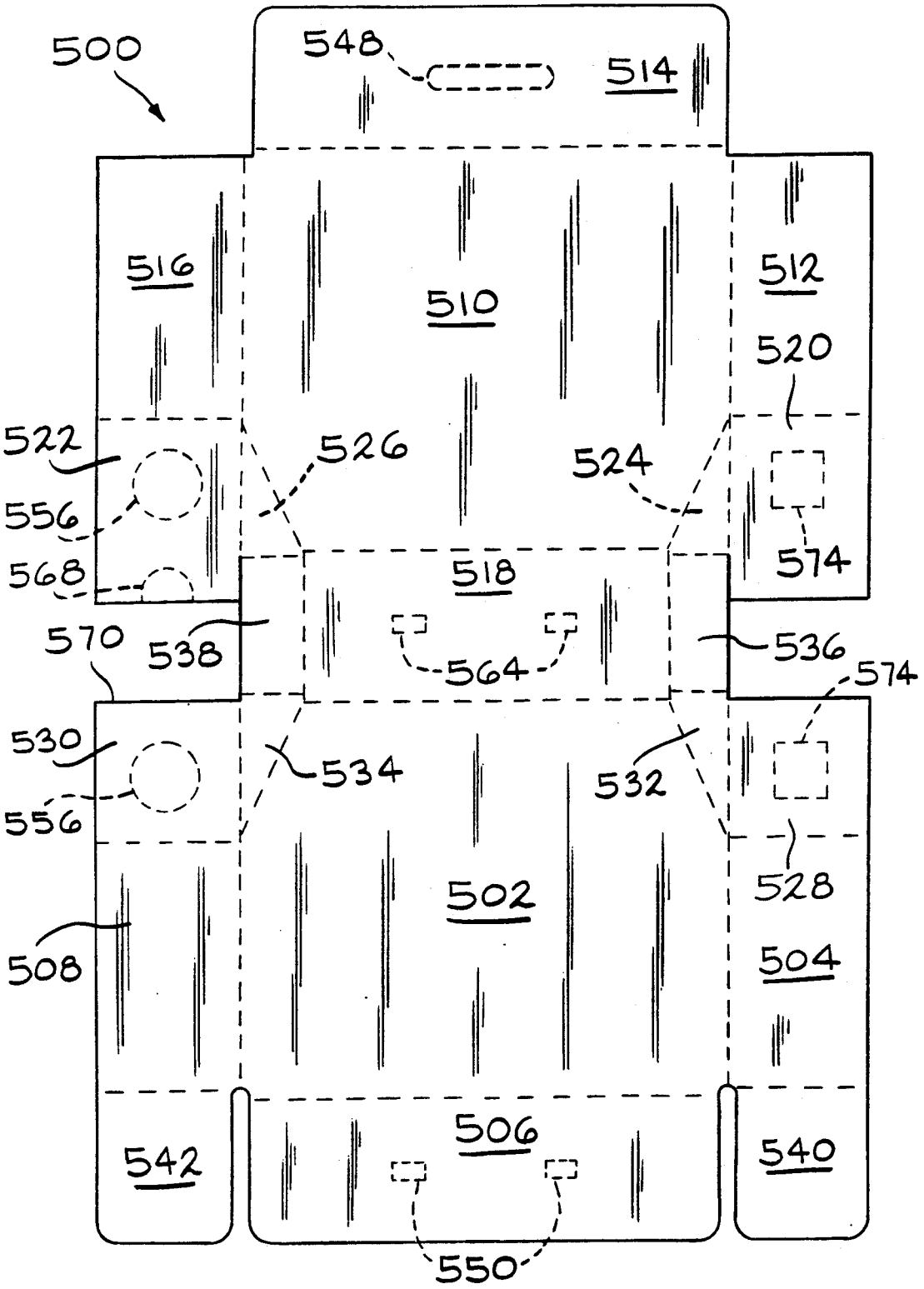
FIG. 24 is a plan view of an integral prescored blank for producing dispensing containers such as those illustrated in FIGS. 25 through 32.

Referring now to FIG. 24, a blank for producing a shipping, storing and dispensing container is indicated generally at 500. The blank 500 comprises a first panel 502, three major, inner side walls 504, 506 and 508 which depend from the first panel 502, a second panel 510, three major, outer side walls 512, 514 and 516 which depend from the second panel, and a fourth side wall 518 connected to and connecting the first panel 502 and the second panel 510. First and second outer, minor walls 520 and 522 are connected to outer major side walls 512 and 516, respectively. The first and second outer, minor walls 520 and 522 are also connected to coupling panels 524 and 526, respectively, and the coupling panels 524 and 526 are connected, in turn, to the second panel 510. First and second inner, minor side walls 528 and 530 are connected to major, inner side walls 504 and 508, respectively. The first and second inner, minor walls 528 and 530 are also connected to coupling panels 532 and 534, respectively, and the coupling panels 532 and 534 are connected, in turn, to the first panel 502. At the ends of the fourth side wall 518, there are set up panels 536 and 538. The coupling panels 524 and 532 are connected to the set up panel 536 and the coupling panels 526 and 534 are connected to the set up panel 538. The coupling panels 532 and 534 are connected to the first panel 502 and the coupling panels 524 and 526 are connected to the second panel 510. Tuck panels 540 and 542 are connected to the major, inner side walls 504 and 508.

The blank 500 is set up in much the same manner as the blank 130, FIG. 4, the blank 264, FIG. 10 and the blank 360, FIG. 20, and, in a preferred embodiment, the blank 500 incorporates all of the set up features described hereinabove for those other blanks. Specifically, the set up panels 538 are manipulated inwardly and upwardly, causing the panels 502 and 510, as well as the side walls 504, 508, 512 and 516, to pivot inwardly and upwardly, until the panels 502 and 510 are substantially parallel. The tuck flaps 540 and 542 are folded inwardly, then the side wall 506 is folded inwardly and, finally, the side wall 514 is folded inwardly, over the side wall 506 and the tuck panels 540 and 542. Glue is applied, as desired, to secure the inner and outer side walls together. The blank 500 can be thus set up to produce a container substantially corresponding with the one indicated generally at 544 in FIGS. 25 and 26. For convenience, a conventional plastic handle 546 can be provided by inserting its ends through a slot 548 (shown in dotted lines in the side wall 514 in FIG. 24) and apertures 550 (shown in dotted lines in the side wall 506 in FIG. 24).

In the container 544, there is a liquid dispensing valve 552 which is mounted on the minor side wall 522 and provides selective communication between the inside and the outside of the container 544. The valve 552, in and of itself, is conventional and there are, on the market today, valves available which are capable of performing the functions required of the valve 552. Such valves are produced by or available from Hedwin Corporation as well as Liqui-Box Corporation. The valve 552 comprises a body 554 which is secured to the inner and outer minor side walls 530 and 522, and extends through apertures 556, shown in dotted lines in FIG. 24, which register with one another and extend through said inner and outer minor side walls 522 and 530. A valve handle 558 is mounted on the valve body 554 for rotation between a first position in which it is operable and a second position in which it is inoperable to permit liquid to flow from inside the container 544, through the valve 552, to the outside of the container 544. Inside the container 544, there is a bag 560 formed of a liquid impervious material such as polyethylene or other flexible plastic material. The bag 560 conforms to the interior surfaces of the container 544 and the bag 560 is in communication with the valve 552 but is otherwise closed. Thus, it will be appreciated that the container 544 is well suited for storing and dispensing a liquid material. In addition, the container is well suited for shipment with other such containers in a larger carton, even with the valve 552 in place because the valve 552 does not extend beyond a plane, P-516, defined by the major side wall 516 and shown in dotted lines in FIG. 25 or beyond a plane, P-518, defined by the major side wall 518 and shown in dotted lines in FIG. 25. In other words, if the major side walls 516 and 518, adjacent to the minor side wall 522 on which the valve 552 is mounted, were extended until they intersected, the valve 552 would not interfere with either extension of the side walls 516 and 518. Instead of the bag 560, there may be provided what is called a bladder (not shown) which, typically, is produced by blow molding a plastic to have a shape corresponding with the inside of the container. Generally speaking, bags and bladders are similar in that they are liquid impervious and are suitable for lining a container according to the present invention, although bladders tend to be stronger than bags.

Figure 27:
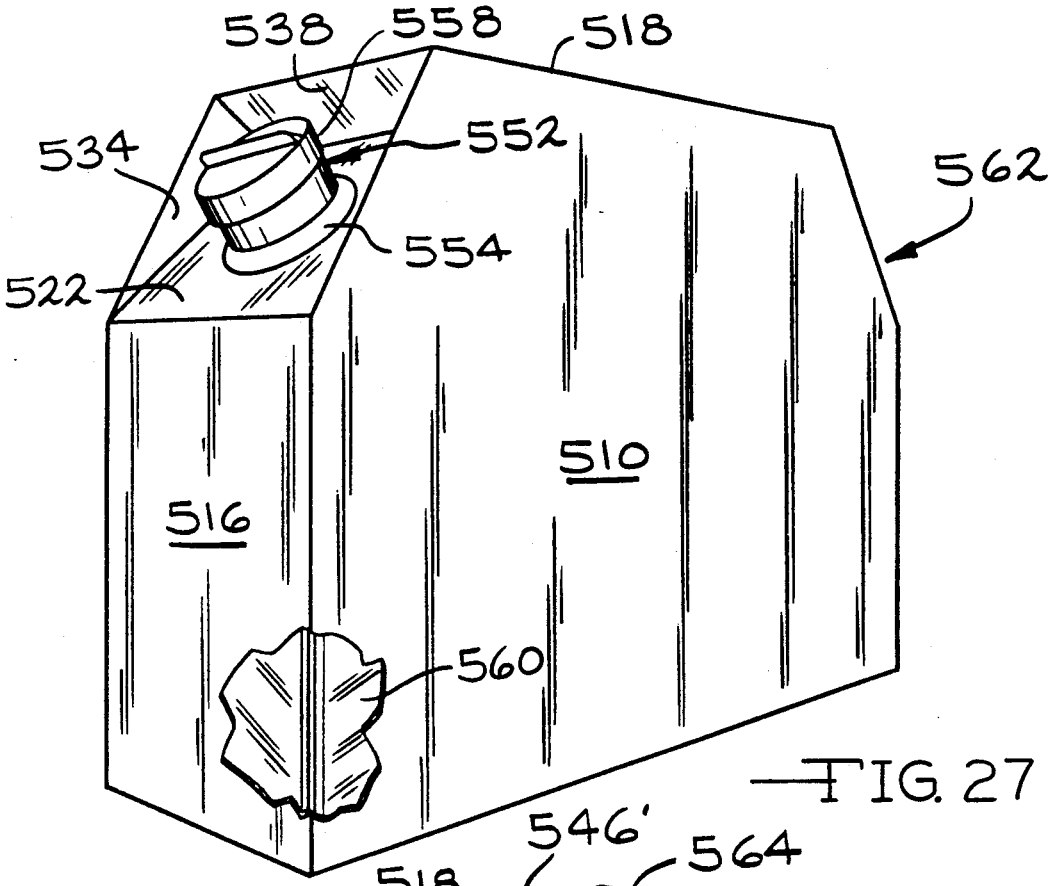
FIG. 27 is a perspective view of a liquid dispensing container including a dispensing valve mounted on an upper, minor, corner cutting side wall.
Figure 28:
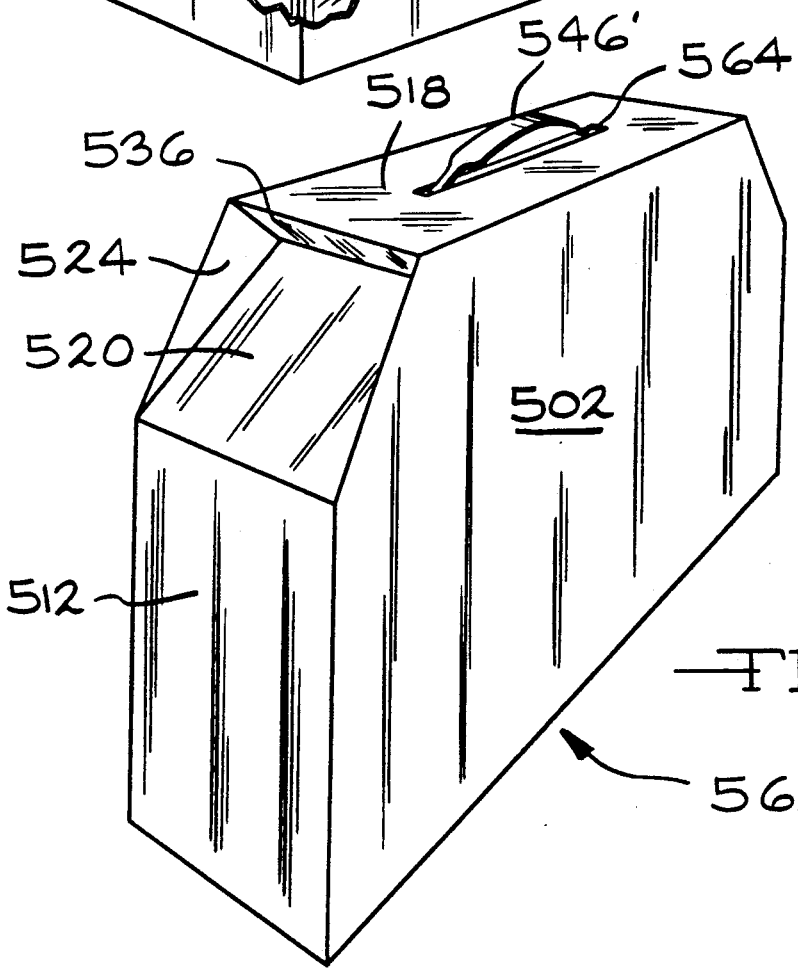
FIG. 28 is a perspective view showing a carrying handle provided on top of the liquid dispensing container shown in FIG. 27.

Referring now to FIGS. 27 and 28, a container which is similar to container 544 is indicated generally at 562. The container includes a handle 546' which is secured in apertures 564 which are formed in the major side wall 518. Thus, it will be appreciated that a dispensing device such as the valve 552 can be provided near the top of a container according to the invention, as shown in FIGS. 27 and 28 for container 562, or near the bottom of a container, as shown in FIGS. 25 and 26 for container 544.

Figure 30:
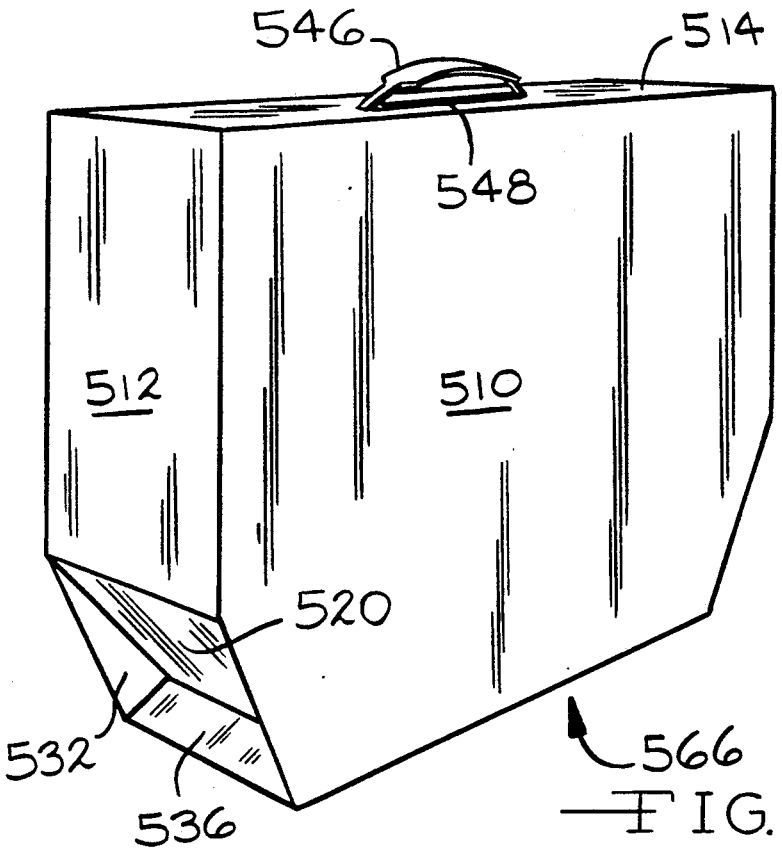
FIG. 30 is a perspective view showing a carrying handle provided on top of the container shown in FIG. 29.
Figure 29:
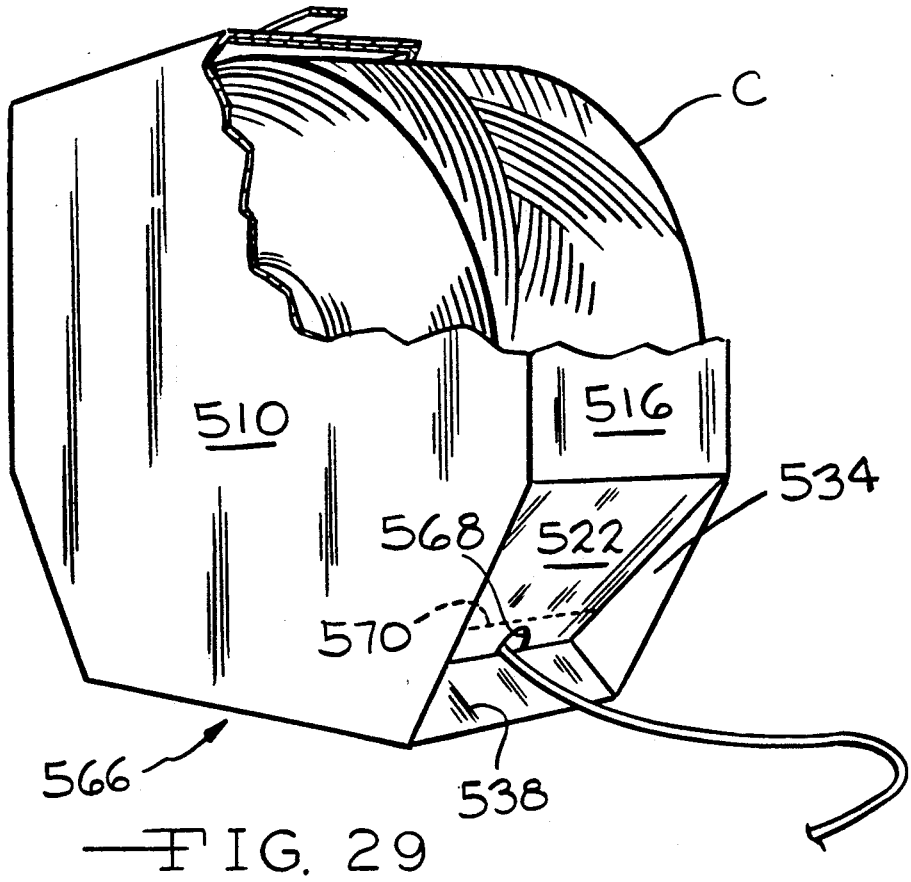
FIG. 29 is a perspective view of a coiled product dispensing container, including a dispensing opening provided on a lower, corner cutting wall.

Referring now to FIGS. 29 and 30, a container for storing, shipping and dispensing a wound product, such as cord C, is indicated generally at 566. A handle 546 is provided and it is secured within a slot 548 and apertures 550 (FIG. 24). A dispensing aperture 568 is formed in the outer, minor side wall 522. The inner, minor side wall 530 terminates at an edge 570 so that the cord C can be dispensed through the aperture 568 without interference from the inner minor side wall 530. If desired, a friction reducing coating (not shown) may be provided on exposed interior surfaces of the container 566 to minimize the forces that would resist rotation of the coiled cord C during dispensing. Such a coating might comprise a polymeric material with a relatively low coefficient of friction.

Figure 31:
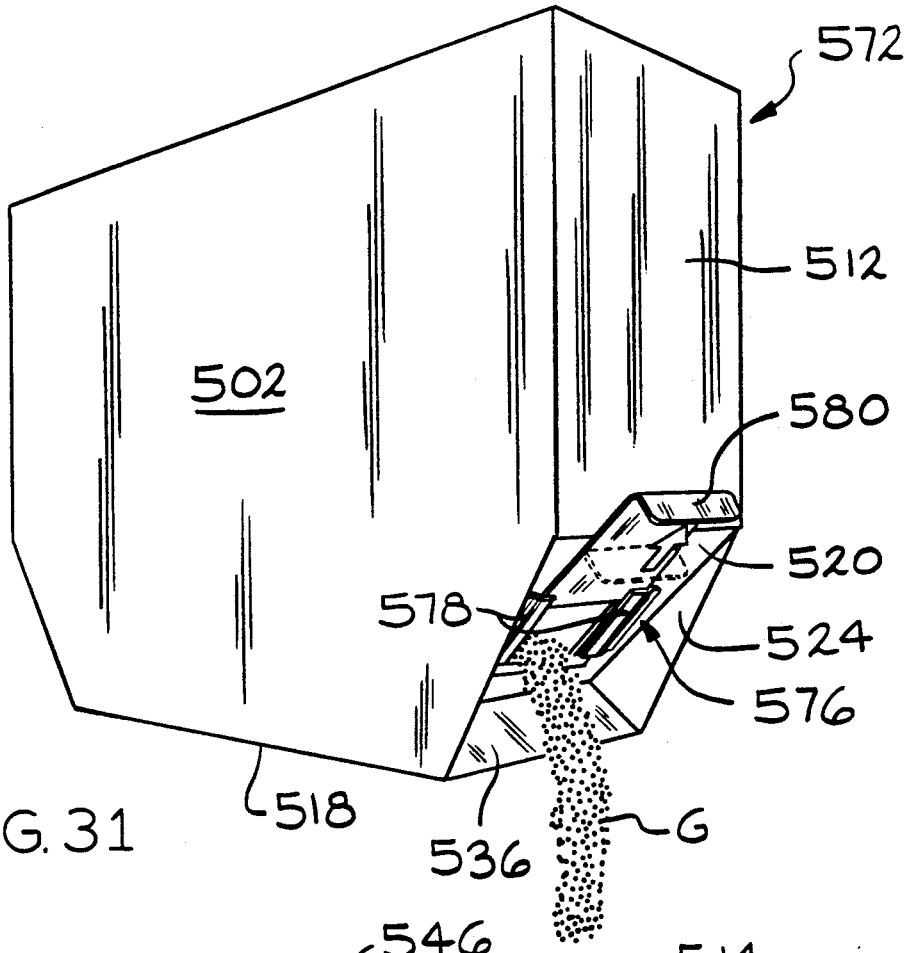
FIG. 31 is a perspective view of a granule dispensing container, including a dispensing device mounted on a lower, minor, corner cutting side wall.
Figure 32:
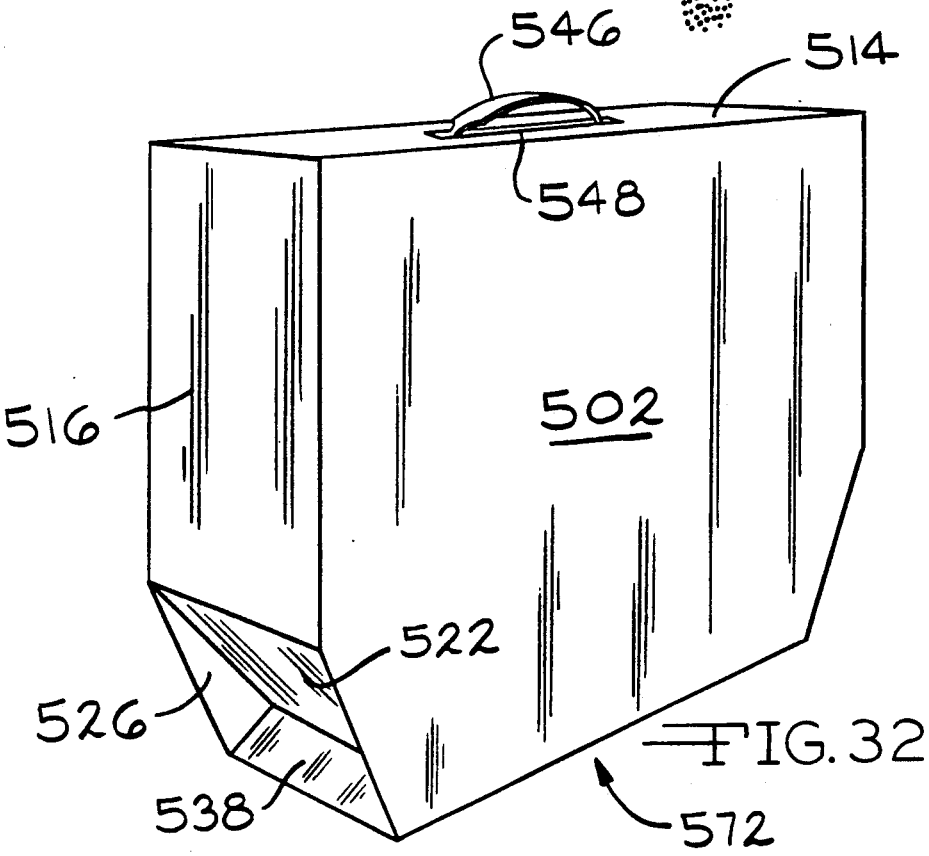
FIG. 32 is a perspective view showing a carrying handle provided on top of the container shown in FIG. 31.

Referring now to FIGS. 31 and 32, a container for storing, transporting and dispensing a dry powdered or granular material is indicated generally at 572. The container can be made from the blank 500 (FIG. 24) with punch outs 574 removed for dispensing the contents of the container 572, in this case, granules G. In the assembled container 572, the apertures formed when the punch outs 574 are removed from the minor side walls 520 and 528 register with one another. A sliding gate valve mechanism, indicated generally at 576, comprises a pair of guide slides 578 and a sliding gate valve plate 580 mounted in the guide slides 578. The gate valve plate 580 can be moved between a first position (shown in dotted lines) in which it is operable and a second position (shown in solid lines) in which it is inoperable to prevent the dispensing of the granules G. The container 572 can be carried by a handle 546 and the contents dispensed, by gravity, through the sliding gate valve 576. When the gate valve plate is in the first position, it does not extend beyond the planes (not shown) defined by the major side walls 512 and 518. Accordingly, the container 572 with the gate valve 576 in place can be shipped in a larger carton with other such containers.

The foregoing detailed description is intended only to disclose the best modes known to the applicant for practicing the invention and to enable one skilled in this art to practice the invention; this description is not intended to limit the invention beyond limitations set forth in the appended claims. Modifications may occur to those skilled in the art, but fall, nonetheless, within the spirit and scope of the following claims. For example, a liquid control valve might be conveniently replaced with a simple fitting which could be connected to a fluid flow control system which is entirely external to a container according to this invention.

I claim:

1. A container formed from a unitary, prescored blank, said container comprising:

first and second panels, first, second, third and fourth major side walls connecting said first and second panels, a minor side wall provided between two adjacent major side walls, said minor side wall cutting the corner which would otherwise be formed if the two adjacent side walls extended to a line where they intersected, said minor side wall being constituted by a first, inner minor side wall panel connected to said first panel and disconnected from said second panel and a first, outer minor side wall panel connected to second panel and disconnected from said first panel, and dispensing means associated with said minor wall for controlling the dispensation of a product contained in the container, said dispensing means including an element which is movable between a first position in which it is operable and a second position in which it is inoperable to prevent the dispensation of a product contained in the container, provided that said dispensing means can be positioned so that it does not extend beyond the planes defined by said two adjacent major side walls.

2. The container claimed in claim 1 wherein said first, second, and third major side walls are constituted by first, second and third inner and outer major side walls and wherein said inner major side walls are connected to and depend from said first panel and wherein said outer major side walls are connected to and depend from said second panel.

3. The container claimed in claim 2 wherein said fourth major side wall connects and is connected to said first and second panels.

4. The container claimed in claim 3 wherein said dispensing means comprises a liquid valve.

5. The container claimed in claim 4 wherein said container additionally comprises a liquid impervious liner which is in communication with said liquid dispensing valve.

6. The container claimed in claim 1 wherein said dispensing means associated with said minor wall includes means for connection with external means for controlling the dispensation of a product contained in the container.

7. The container claimed in claim 1 wherein at least one aperture is formed in each of the inner and outer, minor side wall panels and wherein, in the carton so formed, one of the apertures in said inner minor side wall panel registers with one of the apertures in said outer minor side wall panel.

8. A container formed from a unitary, prescored blank, said container comprising:

first and second panels, first, second, third and fourth major side walls connecting said first and second panels, a minor side wall provided between two adjacent major side walls, said minor side wall cutting the corner which would otherwise be formed if the two adjacent side walls extended to a line where they intersected, said minor side wall being constituted by a first, inner minor side wall panel connected to said first panel and disconnected from said second panel and a first, outer minor side wall panel connected to second panel and disconnected from said first panel, a first coupling panel connected to said inner minor side wall panel and connected to said first panel, a second coupling panel connected to said outer minor side wall panel and connected to said first panel, and dispensing means associated with said minor wall for controlling the dispensation of a product contained in the container, said dispensing means including an element which is movable between a first position in which it is operable and a second position in which it is inoperable to prevent the dispensation of a product contained in the container, provided that said dispensing means can be positioned so that it does not extend beyond the planes defined by said two adjacent major side walls.

9. The container claimed in claim 8 which further comprises a set up panel which is connected to said first and second coupling panels and to one of said major side walls.

10. The container claimed in claim 8 wherein at least one aperture is formed in each of the inner and outer, minor side wall panels and wherein, in the carton so formed, one of the apertures in said inner minor side wall panel registers with one of the apertures in said outer minor side wall panel.

* * * * *